US008722292B2

(12) United States Patent
Seitoku

(10) Patent No.: US 8,722,292 B2
(45) Date of Patent: May 13, 2014

(54) ELECTROSTATIC IMAGE DEVELOPING TONER, INVISIBLE INFORMATION TONER, ELECTROSTATIC IMAGE DEVELOPER, PROCESS CARTRIDGE AND IMAGE FORMATION APPARATUS

(75) Inventor: Shigeru Seitoku, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 897 days.

(21) Appl. No.: 12/100,724

(22) Filed: Apr. 10, 2008

(65) Prior Publication Data

US 2009/0011354 A1 Jan. 8, 2009

(30) Foreign Application Priority Data

Jul. 3, 2007 (JP) ..... 2007-174753

(51) Int. Cl.
*G03G 9/087* (2006.01)

(52) U.S. Cl.
USPC ..... 430/108.21; 430/108.2

(58) Field of Classification Search
USPC ..... 430/108.2, 124.4, 108.21
See application file for complete search history.

(56) References Cited

U.S. PATENT DOCUMENTS

| | | | | |
|---|---|---|---|---|
| 5,262,264 | A | 11/1993 | Shimizu et al. | |
| 2002/0150830 | A1 * | 10/2002 | Katagiri et al. | 430/108.24 |
| 2003/0073017 | A1 | 4/2003 | Fields et al. | |
| 2006/0018688 | A1 * | 1/2006 | Nakamura et al. | 399/336 |
| 2006/0019187 | A1 | 1/2006 | Nakamura | |
| 2006/0207477 | A1 | 9/2006 | Ganschow et al. | |

FOREIGN PATENT DOCUMENTS

| | | | | |
|---|---|---|---|---|
| JP | A-61-143769 | | 7/1986 | |
| JP | A-61-217055 | | 9/1986 | |
| JP | A-3-059677 | | 3/1991 | |
| JP | 03198065 | A * | 8/1991 | |
| JP | 04043366 | A * | 2/1992 | |
| JP | 05100470 | A * | 4/1993 | G03G 9/08 |
| JP | 05100487 | A * | 4/1993 | |
| JP | 06102703 | A * | 4/1994 | |
| JP | A-07-157471 | | 6/1995 | |
| JP | A-2004-93995 | | 3/2004 | |
| JP | A-2004-233729 | | 8/2004 | |
| JP | A-2004-271793 | | 9/2004 | |
| JP | A-2004-309757 | | 11/2004 | |
| JP | A-2005-201985 | | 7/2005 | |
| JP | A-2005-270867 | | 10/2005 | |
| JP | A-2006-038933 | | 2/2006 | |
| JP | A-2006-078888 | | 3/2006 | |
| JP | A-2006-251378 | | 9/2006 | |
| JP | A-2006-267511 | | 10/2006 | |
| WO | WO 2004/020529 | A1 | 3/2004 | |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Diamond, Arthur S & David Weiss (eds.) Handbook of Imaging Materials, 2nd ed.. New York: Marcel-Dekker, Inc. (Nov. 2001) pp. 187 & 188.*

English language machine translation of JP 05-100487 (Apr. 1993).*

English language machine translation of JP 06-102703 (Apr. 1994).*

English language machine translation of JP 05-100470 (Apr. 1993).*

Diamond, Arthur S & David Weiss (eds.) Handbook of Imaging Materials, 2nd ed.. New York: Marcel-Dekker, Inc. (Nov. 2001) pp. 178-182.*

English language machine translation of JP 04-043366 (Feb. 13, 1992).*

Dec. 18, 2009 Office Action issued in Australian Patent Application No. 2008202117.

Office Action dated Jul. 12, 2011 issued in Japanese Patent Application No. JP 2007-174753. (With translation).

Sep. 8, 2011 Office Action issued in Chinese ApplicationNo. 200810099555.0 (with translation).

* cited by examiner

*Primary Examiner* — Christopher Rodee

(74) *Attorney, Agent, or Firm* — Oliff PLC

(57) ABSTRACT

The invention relates to an electrostatic image developing toner comprising at least one of a phthalocyanine type compound and a naphthalocyanine type compound and at least one compound represented by the following structural formulae (1) to (10):

(1)

(2)

(3)

(4)

-continued (5)

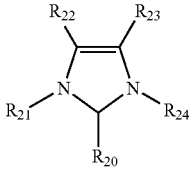

(6)

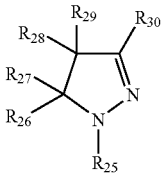

(7)

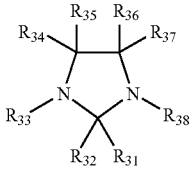

(8)

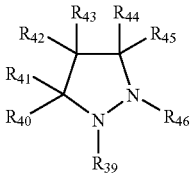

-continued (9)

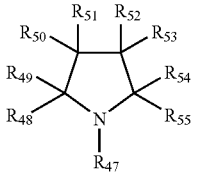

(10)

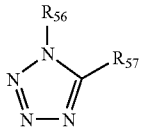

wherein $R_1$ to $R_{57}$ respectively represent a hydrogen atom, an alkyl group, an aryl group, an arylalkyl group, an amino group, a halogen group, an alkoxy group, an alkylthio group, a nitro group, a hydroxy group, a thiol group, an alkylcarbonyl group, an alkoxycarbonyl group, an alkylcarbonylamino group, an alkoxycarbonylamino group, a carboxyamide group or a nitroimino group, wherein among $R_1$ to $R_{57}$, any two adjacent Rs may form a carbon ring and any two Rs connected to the same carbon atom may form an oxo group, an imino group or a thioxo group.

18 Claims, 2 Drawing Sheets

ELECTROSTATIC IMAGE DEVELOPING TONER, INVISIBLE INFORMATION TONER, ELECTROSTATIC IMAGE DEVELOPER, PROCESS CARTRIDGE AND IMAGE FORMATION APPARATUS

CROSS-REFERENCE TO RELATED APPLICATIONS

This application is based on and claims priority under 35 USC 119 from Japanese Patent Application No. 2007-174753 filed Jul. 3, 2007.

BACKGROUND

1. Technical Field

The invention relates to an electrostatic image developing toner, an invisible information toner, an electrostatic image developer, a process cartridge and an image formation apparatus.

2. Related Art

Methods such as an electrophotographic method, used to form image information through an electrostatic image, are utilized in various fields. In the electrophotographic method, an electrostatic latent image is formed on an image support in a charge and exposure processes (latent image formation process) and an electrostatic latent image is developed using an electrostatic image developer (hereinafter, simply called "developer" depending on the situation) containing an electrostatic image developing toner (hereinafter, simply called "toner" depending on the situation), followed by a transfer process and a fixing process to make the image visible. The developer used here includes a two-component developer including a toner and a carrier, and a one-component developer using a magnetic toner or a nonmagnetic toner singly. As a conventional method of producing the toner, the kneading milling method is used in which a binder resin such as a thermoplastic resin is melted and kneaded together with a colorant such as a pigment, a charge control agent, a releasing agent such as wax and the like, and the resulting mixture is cooled, milled and further classified. The toner particles obtained in this manner are sometimes treated according to the requirements by adding inorganic or organic particles to the surface of these toner particles to improve the fluidity and cleaning ability of these toner particles.

Also, as the method of producing an electrostatic image developing toner, various chemical toner production methods have been developed and put to practical use which are typified by a suspension polymerization method and dissolution suspension method including an emulsion polymerization coagulating method to produce a toner. In, for example, the emulsion polymerization coagulating method, a dispersion solution of a resin formed by emulsion-polymerizing a polymerizable monomer of a binder resin and a particle dispersion solution of a colorant, releasing agent and the like are mixed with stirring in an aqueous solvent in the presence of a surfactant to coagulate and thermally fuse, thereby producing color resin particles, which are a toner having a specified particle diameter, grain size, shape and structure.

In recent years, the color electrophotographic method has spread significantly, and the fields in which this method is used have been widened with the spread of the color photographic method. Examples of these fields include a field of invisible information toners (invisible toners) used for the copyright protection of digital works such as stationary images, and prevention of illegal copying and utilized for ID cards and the like by embedding addition data recording additional information in an image in a superimposed manner, to prevent forgery and to improve security.

Particularly, the recent development of copy machine printers has made it easy to duplicate paper money, a copy of one's family resister, a written contract and the like, giving rise to problems concerning illegal copying and illegal uses.

The invisible information toner to be used for the purpose of preventing such illegal copying and the like means a toner which has almost no absorption in the visible wavelength region though it has absorption in the ultraviolet wavelength region or near-infrared wavelength region, and makes it possible to read information by any ultraviolet light or near-infrared light. For this, a bar code and an any code are imaged using the toner to embed personal or company information, voice information, or the like and the embedded information can be read by a scanner or the like.

Such an invisible information toner is characterized by the feature that it has no absorption (or almost no absorption) in the visible wavelength region and has strong absorption at an any wavelength in the near-infrared wavelength region. Here, in order for a toner to be increased in the absorption of light in the near-infrared wavelength region for the purpose of, for example, improving image-reading precision, some conventional methods are being adopted which include a method in which a large amount of near-infrared ray absorbing agent is added to the toner and a method in which the particle diameter of a near-infrared ray absorbing agent in the toner is decreased.

SUMMARY

According to an aspect of the invention, there is provided an electrostatic image developing toner including at least one of a phthalocyanine type compound and a naphthalocyanine type compound and at least one compound represented by the following structural formulae (1) to (10).

(1)

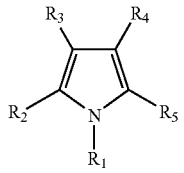

(2)

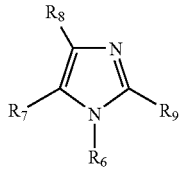

(3)

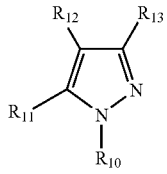

-continued (4)

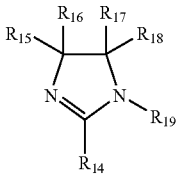

(5)

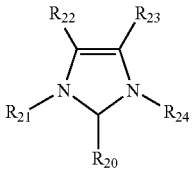

(6)

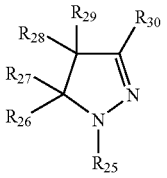

(7)

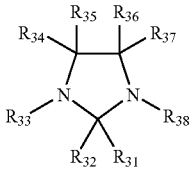

(8)

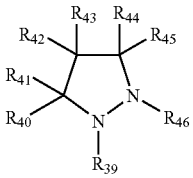

(9)

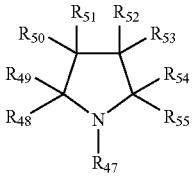

(10)

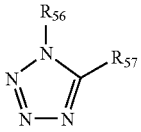

In the formulae (1) to (10), $R_1$ to $R_{57}$ respectively represent a hydrogen atom, an unsubstituted alkyl group, an aryl group, an arylalkyl group, an amino group, a halogen group, an alkoxy group, an alkylthio group, a nitro group, a hydroxy group, a thiol group, an alkylcarbonyl group, an alkoxycarbonyl group, an alkylcarbonylamino group, an alkoxycarbonylamino group, a carboxyamide group or a nitroimino group. Among $R_1$ to $R_{57}$, any two adjacent Rs may form a carbon ring and any two Rs connected to the same carbon atom may form an oxo group, an imino group or a thioxo group.

BRIEF DESCRIPTION OF THE DRAWINGS

Exemplary embodiment (s) of the present invention will be described in detail based on the following figures, wherein.

DETAILED DESCRIPTION

Figure 1:
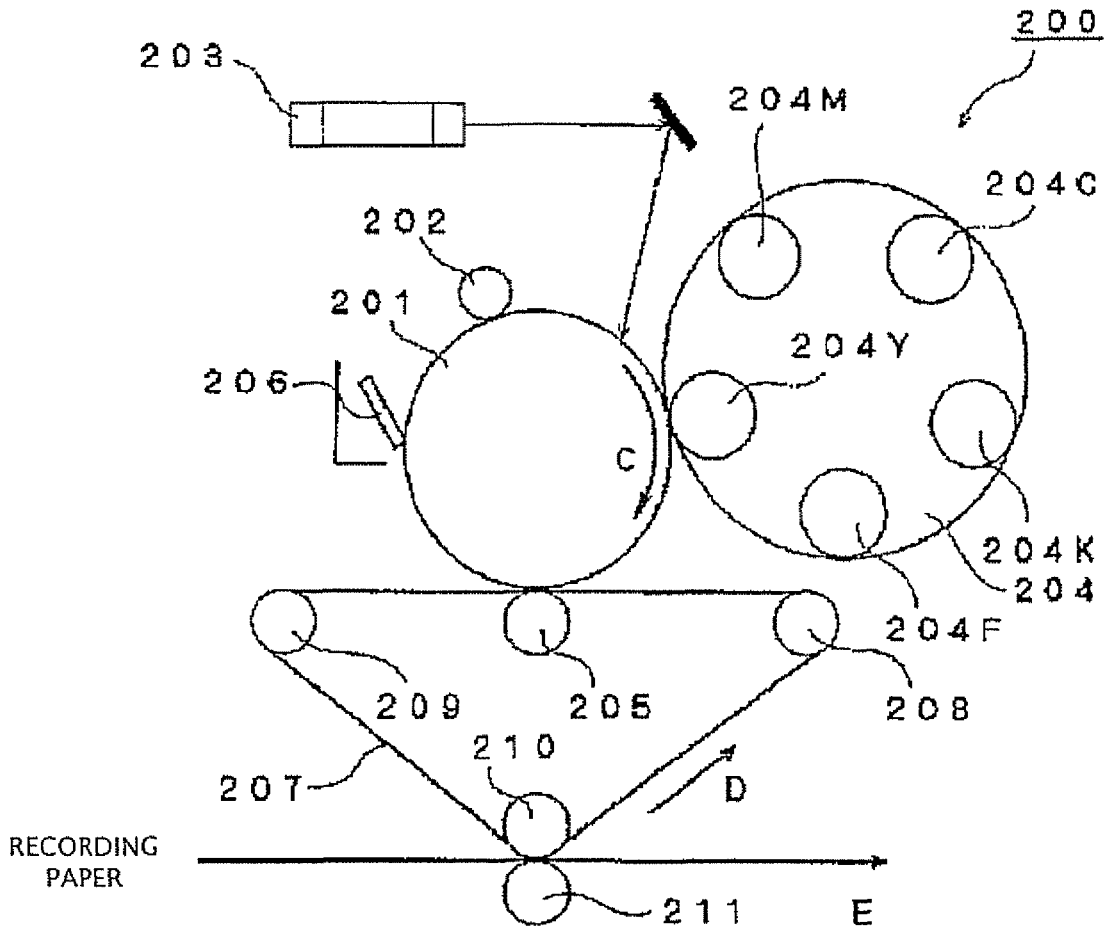
FIG. 1 is a schematic view showing a structural example of an image formation apparatus that forms an invisible image and a visible image according to an exemplary embodiment in the present invention.

Exemplary embodiments of the present invention will be explained hereinbelow. These embodiments are examples of the invention and are not intended to limit the invention.

(Electrophotographic Toner)

An electrostatic image developing toner according to an exemplary embodiment of the present invention contains at least one of a phthalocyanine type compound and a naphthalocyanine type compound and at least one compound represented by the following structural formulae (1) to (10).

(1)

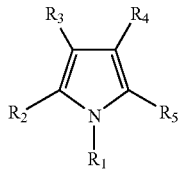

(2)

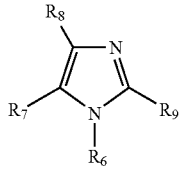

(3)

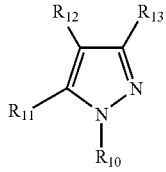

(4)

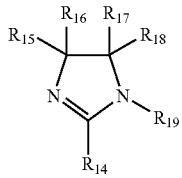

(5)

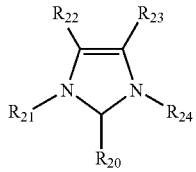

(6)

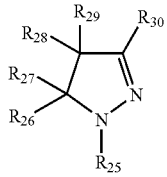

-continued (7)

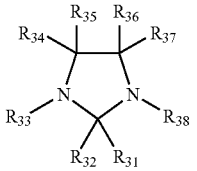

(8)

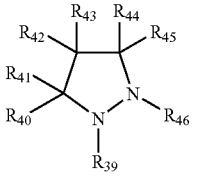

(9)

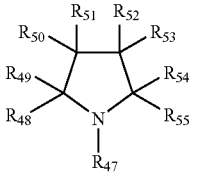

(10)

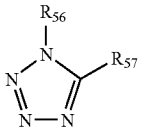

In the formulae (1) to (10), $R_1$ to $R_{57}$ respectively represent a hydrogen atom, an unsubstituted alkyl group, an aryl group, an arylalkyl group, an amino group, a halogen group, an alkoxy group, an alkylthio group, a nitro group, a hydroxy group, a thiol group, an alkylcarbonyl group, an alkoxycarbonyl group, an alkylcarbonylamino group, an alkoxycarbonylamino group, a carboxyamide group or a nitroimino group. Among $R_1$ to $R_{57}$, any two adjacent Rs may form a carbon ring and any two Rs connected to the same carbon atom may form an oxo group, an imino group or a thioxo group.

Examples of $R_1$ to $R_{57}$ include a hydrogen atom, straight-chain, branched or cyclic alkyl groups such as a methyl group, ethyl group, propyl group and butyl group; aryl groups such as a phenyl group and naphthyl group; arylalkyl groups such as a benzyl group; amino groups; halogen groups such as fluorine, chlorine, bromine and iodine; alkoxy groups such as a methoxy group and ethoxy group; alkylthio groups such as a methylthio group and ethylthio group; nitro groups; hydroxy groups; thiol groups; alkylcarbonyl groups such as a methylcarbonyl group and ethylcarbonyl group; alkoxycarbonyl groups such as a methoxycarbonyl group and ethoxycarbonyl group; alkylcarbonylamino groups such as a methylcarbonylamino group, ethylcarbonylamino group and trifluoromethylcarbonylamino group; alkoxycarbonylamino groups such as a methoxycarbonylamino group, ethoxycarbonylamino group and t-butoxycarbonylamino group, carboxyamide groups and nitroimino groups. Among $R_1$ to $R_{57}$, any two adjacent Rs may form a carbon ring such as a benzene ring and any two Rs connected to the same carbon atom may form an oxo group (>C═O), an imino group (>C═NH) or a thioxo group (>C—S).

Also, aryl groups such as a phenyl group and naphthyl group may have an alkyl group having 1 to 4 carbon atoms such as a methyl group and a halogen group.

When the structure of the above additive contains a substituent, though a substituent other than a hydrogen atom may exist or not, the substituent may have a steric hindrance to the near-infrared absorbing agent particles if the substituent is too bulky and there are cases where the affinity of the additive to the near-infrared absorbing agent particles is decreased, and therefore it is preferable that the substituent is as non-bulky as possible. Consequently, $R_1$ to $R_{57}$ are respectively preferably a hydrogen atom, a straight-chain alkyl group having about 1 or more and about 4 or less carbon atoms, a straight-chain alkoxy group having about 1 or more and about 4 or less carbon atoms, a straight-chain alkylthio group having about 1 or more and about 4 or less carbon atoms, or a straight-chain alkoxycarbonyl group having about 1 or more and about 4 or less carbon atoms. Also, there may be cases where the wavelength of light absorbed by the near-infrared absorbing agent is elongated by the effect of the coagulation of the near-infrared absorbing agent particles with the additive. Therefore, from the viewpoint of affinity to the phthalocyanine type compound or naphthalocyanine type compound and the elongated wavelength of near-infrared absorbing agent, $R_1$ to $R_{57}$ are respectively preferably an electron-donating substituent, for example, a straight-chain alkyl group having about 1 or more and about 4 or less carbon atoms, a phenyl group, an amino group, a straight-chain alkoxy group having about 1 or more and about 4 or less carbon atoms or a straight-chain alkylthio group having about 1 or more and about 4 or less carbon atoms. Also, when the toner is used in invisible toner applications, it is invisible when it is colored, and therefore an almost uncolored but faintly colored compound is preferable, and a white compound is more preferable.

Also, for the same reason as above, the number of substituents other than a hydrogen atom is preferably 0 or more and about 5 or less, more preferably 0 or more and about 3 or less and still more preferably 0 or about 1. Also, when the number of substituents other than a hydrogen atom is about 1 or more, the additive may have a bulky structure and there may be therefore a fear that the affinity to the near-infrared absorbing agent particles is likewise deteriorated. Therefore, at least four of $R_1$ to $R_5$ in the formula (1), at least three of $R_6$ to $R_9$ in the formula (2), at least three of $R_{10}$ to $R_{13}$ in the formula (3), at least five of $R_{14}$ to $R_{19}$ in the formula (4), at least four of $R_{20}$ to $R_{24}$ in the formula (5), at least five of $R_{25}$ to $R_{30}$ in the formula (6), at least seven of $R_{31}$ to $R_{38}$ in the formula (7), at least seven of $R_{39}$ to $R_{45}$ in the formula (8), at least eight of $R_{47}$ to $R_{55}$ in the formula (9) and at least one of $R_{56}$ to $R_{57}$ in the formula (9) are preferably hydrogen atoms.

Also, the melting temperature of a compound represented by the above formulae (1) to (10) is preferably about 10° C. or more and about 200° C. or less and more preferably about 20° C. or more and about 100° C. or less. When the melting temperature of the compound is less than 100° C., the additive may bleed out of the toner, and there may be cases where offset arises. Also, when the melting temperature exceeds about 200° C., this temperature is higher than the usual fixing temperature and may be therefore not melted when producing the toner or the toner is fixed. Therefore, it may be difficult to endow the additive with affinity to the near-infrared absorbing agent particles and the effect of preventing the coagulation of the near-infrared absorbing agent may be easily deteriorated.

As the toner according to an exemplary embodiment of the present invention, a toner produced by the hetero-coagulation method is more preferable than a toner produced by the kneading milling method. In the case of the kneading milling method, the kneading temperature may be about 100° C. or more and also, the fluidity may be not high and there is therefore the possibility that it will be difficult to endow the additive with affinity to the near-infrared absorbing agent particles. Also, there may be cases where the additive is decomposed by mechanical impact.

The amount of the compound represented by the above formulae (1) to (10) is preferably about 0.1 parts by weight or more and about 10 parts by weight or less and more preferably about 0.5 parts by weight or more and about 8 parts by weight or less based on the weight of the toner. When the amount the compound is less than about 0.1 parts by weight, there may be cases where the effect of the additive is reduced, whereas when the amount of the compound exceeds about 10 parts by weight, the ratio of the binder resin is reduced and there may be therefore cases where the strength of the toner is reduced and the chargeability of the toner is adversely affected.

If the toner is one produced by the hetero-coagulation method, on the other hand, the fluidity in the toner may be high when the toner is produced and the mechanical impact may be low, and therefore the additive may be easily endowed with affinity to the near-infrared absorbing agent particles.

(Toner Production Method)

Although the electrostatic image developing toner according to an exemplary embodiment of the present invention is not particularly limited in its use as long as it is used as a toner, it is suitable for use as an invisible information pattern formation toner (invisible information toner) in consideration of toner characteristics.

As a method of producing the toner, any of the kneading milling method, emulsion polymerization coagulating method and suspension polymerization method may be used. However, the hetero-coagulation method such as the emulsion polymerization coagulating method or suspension polymerization method is more desirable than the kneading milling method in terms of ease of endowing the additive with affinity to the near-infrared absorbing agent.

The method of producing the toner according to the emulsion polymerization coagulating method will be explained in more detail. First, a resin dispersion solution in which resin particles are dispersed, a near-infrared absorbing dispersion solution and an additive dispersion solution are mixed to prepare a dispersion solution including coagulated particles containing the resin particles, the near-infrared absorbing agent and the additive (the coagulated particles are color particles further containing a colorant, as the case may be). Then, the resulting dispersion solution is heated to a temperature higher than the glass transition temperature or melting temperature of the resin particles to melt and fuse these ingredients, thereby forming toner particles.

The binder resin used for the toner is preferably, though not particularly limited to, a resin obtained by polymerizing a polymerizable monomer having a vinyl type double bond, for example, in the case of using the emulsion polymerization coagulating method, and more preferably a styrene/acryl type copolymer resin containing a repeat unit of an unsaturated carboxylic acid. Specifically, materials listed below may be used.

Examples of monomers include, for example, styrenes such as styrene and parachlorostyrene; vinyl esters such as vinyl naphthalene, vinyl chloride, vinyl bromide, vinyl fluoride, vinyl acetate, vinyl propionate, vinyl benzoate and vinyl butylate; methylene aliphatic carboxylates such as methyl acrylate, ethyl acrylate, n-butyl acrylate, isobutyl acrylate, dodecyl acrylate, n-octyl acrylate, 2-chloroethyl acrylate, phenyl acrylate, methyl α chloroacrylate, methyl methacrylate, ethyl methacrylate and butyl methacrylate; acrylonitrile; methacrylonitrile; acrylamide; vinyl ethers such as vinyl methyl ether, vinyl ethyl ether and vinyl isobutyl ether; monomers containing a polar group including a nitrogen element, for example, N-vinyl compounds such as N-vinylpyrrole, N-vinylcarbazole, N-vinylindole and N-vinylpyrrolidone; and vinylcarboxylic acids such as methacrylic acid, acrylic acid, cinnamic acid and carboxyethylacrylate.

In the emulsion polymerization process, an emulsifier (dispersant) can be used to form emulsion particles of the resin. Preferred examples of the emulsifier (dispersant) include water-soluble macromolecules such as polyvinyl alcohol, methyl cellulose, ethyl cellulose, hydroxyethyl cellulose, carboxymethyl cellulose, sodium polyacrylate and sodium polymethacrylate, surfactants, for example, anionic surfactants such as sodium dodecylbenzenesulfonate, sodium octadecylsulfate, sodium oleate, sodium laurate and potassium stearate, cationic surfactants such as laurylamine acetate, stearylamine acetate and lauryltrimethylammonium chloride, zwitterionic surfactants such as lauryldimethylamine oxide and nonionic surfactants such as polyoxyethylene alkyl ether, polyoxyethylene alkylphenyl ether and polyoxyethylene alkylamine, and inorganic compounds such as tricalcium phosphate, aluminum hydroxide, calcium sulfate, calcium carbonate and barium carbonate.

When an inorganic compound is used as the dispersant, a commercially available one may be used as it is. However, a method may be adopted in which inorganic compound particles are produced in a dispersant with the view of obtaining microparticles. The amount of the dispersant to be used is preferably about 0.01 parts by weight or more and about 20 parts by weight or less based on about 100 parts by weight of the resin (binder resin).

In the case of the production method using the hetero-coagulation method, for example, the emulsion polymerization coagulating method uses, as starting material, a raw material made into particles usually of about 1 Mm or less. Therefore, this method is preferable since a toner having a small diameter and a narrow distribution of grain size can be efficiently produced and a high-quality fixed image can be obtained.

The volume average particle diameter (median diameter) of the binder resin particles in the binder resin particle dispersion solution obtained in this manner is preferably about 1 μm or less, more preferably about 50 nm or more and about 400 nm or less and still more preferably about 70 nm or more and about 350 nm or less. In this case, the volume average particle diameter of the binder resin particles may be measured by a laser diffraction type grain size distribution measuring device (trade name: LA-700, manufactured by HORIBA Ltd.)

When the near-infrared absorbing agent and additive are dispersed, the same dispersant that is used to disperse the binder resin may be used as a surfactant or dispersant to be used for the dispersion. It is preferable, however, to standardize the dispersant as much as possible.

As the method of dispersing the near-infrared absorbing agent and additive, optional methods such as conventional dispersion methods using, for example, a rotating shearing type homogenizer, ball mill with media, sand mill or dynomill may be used without any particular limitation.

The volume average particle diameter (median diameter) of particles in the near-infrared absorbing agent particle dispersion solution and additive dispersion solution obtained in this manner is preferably about 2 μm or less, more preferably about 0.5 μm or more and about 1.5 μm or less and still more preferably about 0.2 μm or more and about 1 μm or less. In this case, the volume average particle diameter of these particles may be measured by a laser diffraction type grain size distribution measuring device (trade name: LA-700, manufactured by HORIBA Ltd.).

Examples of the releasing agent to be used in an exemplary embodiment of the present invention may include low-molecular weight polyolefins such as polyethylene, polypropylene and polybutene; silicones exhibiting softening point by heating; fatty acid amides exhibiting softening point by heating such as oleic acid amide, erucic acid amide, recinoleic acid amide and stearic acid amide; vegetable type waxes exhibiting softening point by heating such as carnauba wax, rice wax, candelilla wax, Japan tallow and jojoba oil; animal type waxes exhibiting softening point by heating such as honey wax; mineral/petroleum type waxes exhibiting softening point by heating such as montan wax, ozokerite, ceresin, paraffin wax, microcrystalline wax and Fisher-Tropsch wax; and denatured waxes obtained by modifying these waxes. These waxes a real most all not dissolved, or dissolved very little, in a solvent such as toluene.

Also, these releasing agents are preferably added in an amount of about 5% by weight or more and about 25% by weight or less based on the total weight of the solid constituting the toner in view of securing the releasability of a fixed image in an oilless fixing system.

In the coagulation process in the production of a toner by using the emulsion polymerization coagulating method, the pH of the solution may be changed to cause coagulation to thereby regulate the size of the particles. A coagulant may be added as measures taken to achieve the coagulation of particles stably and quickly or to obtain coagulated particles having a narrower distribution of grain size at the same time.

As the coagulant, compounds having a charge with one or more valences are preferable. Specific examples of compounds which respectively have a charge with one or more valences and can be preferably used as the coagulant include, though are not limited to, water-soluble surfactants such as the aforementioned ionic surfactants and nonionic surfactants; acids such as hydrochloric acid, sulfuric acid, nitric acid, acetic acid and oxalic acid; salts of inorganic acids such as magnesium chloride, sodium chloride, aluminum sulfate, calcium sulfate, ammonium sulfate, aluminum nitrate, silver nitrate, copper sulfate and sodium carbonate; metal salts of aliphatic acids or aromatic acids such as sodium acetate, potassium formate, sodium oxalate, sodium phthalate and potassium salicylate; metal salts of phenols such as sodium phenolate; and inorganic acid salts of aliphatic or aromatic amines such as metal salts of amino acids, triethanol amine hydrochloride and aniline hydrochloride.

In consideration of the stability of coagulated particles and the stability of the coagulant to heat or with time, and the removal of the coagulant, the above metal salts of inorganic acids among these coagulants are particularly preferable in view of performance and use. Specific examples of these metal salts include salts of inorganic acids such as magnesium chloride, sodium chloride, aluminum sulfate, calcium sulfate, ammonium sulfate, aluminum nitrate, silver nitrate, copper sulfate and sodium carbonate.

The amount of these coagulants, though differing depending on the valence number of the charge, may each be small, and is about 3% by weight or less in the case of a monovalent compound, about 1% by weight or less in the case of a divalent compound and about 0.5% by weight or less in the case of a trivalent compound based on the total weight of the solid constituting the toner. As the amount of the coagulant is smaller, it is more preferable, and therefore a compound having a larger valence is more preferable.

In the method of producing a toner in an exemplary embodiment of the present invention, the process advances to a washing process according to the requirements need after the fusing process is finished, and then progresses through a solid-liquid separating process and a drying process, whereby a toner according to the exemplary embodiment of the present invention can be obtained. At this time, it is preferable to carry out substitutive washing with ion exchange water sufficiently in the washing process in consideration of chargeability. Although no particular limitation is imposed on the solid-liquid separation process, for example, suction filtration and pressure filtration are preferable from the viewpoint of productivity. Although no particular limitation is imposed on the drying process, it is preferable to use, for example, freeze drying, flash jet drying, fluid drying or oscillation type fluid drying in view of productivity.

A toner according to an exemplary embodiment of the present invention, may be one having the so-called core-shell structure in which an outer shell (shell layer) containing a resin and other components is provided on the surface of a toner mother particle (core layer) which is a major component. When the toner has a core-shell structure, the core layer is made, for example, to contain the phthalocyanine type compound or naphthalocyanine type compound, which is confined within the shell layer, thereby improving the chargeability.

The volume average particle diameter D50v of the toner is preferably about 3 μm or more and about 6 μm or less, more preferably about 3.5 μm or more and about 5 μm or less. When the volume average particle diameter D50v of the toner is less than about 3 μm, fine powder may be increased, which is an easy cause of toner fogging and inferior cleaning.

Also, the index GSDv of the volume average grain size distribution of the electrostatic image developing toner according to an exemplary embodiment of the present invention is preferably about 1.0 or more and about 1.3 or less, more preferably about 1.1 or more and about 1.3 or less and still more preferably about 1.15 or more and about 1.24 or less. When GSDv exceeds about 1.3, coarse particles and micropowder particles existing in the toner are increased, and therefore the coagulation of the toners among them may be violently increased, which may tend to be a cause of charge failure and transfer failure. On the other hand, when GSDv is less than about 1.1, this may result in remarkable difficulty in the production.

Here, the volume average particle diameter D50v and the index GSDv of the volume average grain size distribution may be obtained by measuring using Coulter Multisizer II-type (manufactured by Beckman Coultar Inc.) in the condition of an aperture diameter of about 100 μm. At this time, the measurement made performed after dispersing the toner in an aqueous electrolyte solution (aqueous solution of ISOTON-II) and further dispersing the toner using ultrasonic waves for about 30 seconds or more. Based on the grain size distribution of the toner measured by the above Coulter Multisizer II-type, the volume and the number of toners in each divided grain size range (channel) are accumulated from the smaller grain size side to depict a cumulative distribution to define the particle diameter at which the accumulation of the distribution is 16%, as D16v, the particle diameter at which the accumulation of the distribution is 50%, as D50v, and the particle diameter at which accumulation of the distribution is 84%, as D84v. At this time, D50v shows a volume average particle diameter and the index (GSDv) of volume average grain size distribution is given by $(D84v/D16v)^{1/2}$.

The average dispersion diameter of the phthalocyanine type compound or naphthalocyanine type compound (near-infrared absorbing agent) contained in the toner is preferably about 1 μm or less and more preferably about 0.5 μm or less. When the average dispersion diameter exceeds about 1 μm, the absorbing ability of the near-infrared absorbing agent may tend to be deteriorated, which may bring about the case where it is necessary to increase the amount of the near-infrared absorbing agent, and may also cause the spectrum to tend to broaden.

In this case, the term "average dispersion diameter" means an average particle diameter of individual near-infrared absorbing agents being dispersed in the toner. This average dispersion diameter may be measured in the following manner: about 1000 particulate near-infrared absorbing agents being dispersed in the toner are observed by TEM (transmission type electron microscope) (trade name: JEM-1010, manufactured by JEOL DATUM LTD.) and the particle diameter of each particle is calculated from the sectional area of an individual particle to calculate an average of the obtained diameters.

Also, the shape factor SF1 of the electrostatic image developing toner according to an exemplary embodiment is given by the following equation and is preferably about 110 or more and about 140 or less, more preferably about 115 or more and about 135 or less, and still more preferably about 120 or more and about 130 or less. When SF1 is less than about 110, the shape of the toner particles is near spherical, which may be occasionally a cause of inferior cleaning after the transfer operation is finished. Also, when SF1 exceeds about 140, not only may be transfer efficiency and quality deteriorated, but there may be also the cases where SF1 exceeds the range of the shape of toner particles obtained in the production method performed at low temperatures in a wet system.

$$SF1=(ML^2/A)\times(\pi/4)\times 100$$

In the above equation, ML represents the maximum length (μm) of the toner and A represents the projected area ($\mu m^2$) of the toner.

The shape factor SF1 of the toner may be measured using a Ruzex image analyzer (trade name: FT, manufactured by Nireco corporation) in the following manner. First, an optical microscopic image of toners spread on a slide glass is taken in the Ruzex image analyzer through a video camera to measure the maximum length (ML) and projected area (A) of about 50 toners, thereby calculating SF1 of an individual toner, to find an average of these individual toners as a shape factor SF1.

(Electrostatic Image Developer)

An electrostatic image developer according to an exemplary embodiment of the present invention may be one-component developer containing a toner according to an exemplary embodiment of the present invention, or a two-component developer containing a carrier and a toner according to another exemplary embodiment of the present invention. When the toner is used as a two-component developer, it is blended with a carrier. The following explanations will be furnished for the case of the two-component developer.

As the carrier used for the two-component developer, any conventional carrier may be used without any particular limitation. Examples of the carrier may include magnetic metals such as iron oxide, nickel and cobalt, magnetic oxides such as ferrite and magnetite, resin coat carriers provided with a resin coating layer on the surface of each of these core materials, and magnetic dispersion type carriers. Also, a resin dispersion type carrier obtained by dispersing a conductive material or the like in a matrix resin can be used. The amount of the resin coated on the carrier is preferably about 50% or more and about 98% or less, more preferably about 60% or more and about 95% or less and still more preferably about 70% or more and about 90% or less based on the surface of the carrier. This reason for this is that because many of the compounds to be added to toners are usually positively charged, with the result that there may be the case where the intrinsic chargeability of the toner is deteriorated, it may be necessary to compensate the amount of charge by resin coating. When the amount of the coated resin is less than about 50% based on the surface of the carrier, there may be cases where less charging causes uneven concentration, whereas when the amount exceeds about 98%, there may be cases where a carrier is produced with difficulty.

Examples of the coating resin/matrix resin used for the carrier may include, though are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride/vinyl acetate copolymer, styrene/acrylic acid copolymer, straight-silicone resin constituted of an organosiloxane bond or its modified product, fluororesin, polyester, polycarbonate, phenol resin, epoxy resin, (meth)acryl type resin, and dialkylaminoalkyl (meth)acryl type resin. Among these compounds, dialkylaminoalkyl(meth)acryl type resins are preferable from the viewpoint of obtaining high charge amount or the like.

Examples of the conductive material may include, though are not limited to, metals such as gold, silver and copper, carbon black and further, titanium oxide, zinc oxide, barium sulfate, aluminum borate, potassium titanate and tin oxide.

Also, examples of the core material of the carrier include magnetic metals such as iron, nickel and cobalt, magnetic oxides such as ferrite and magnetite and glass beads. The core material is preferably magnetic material to use the carrier in a magnetic brush method. The volume average particle diameter of the core material of the carrier is usually about 10 μm or more and about 500 μm or less, and preferably about 30 μm or more and about 100 μm or less.

In order to coat the surface of the core material of the carrier with a resin, a method is exemplified in which the surface of the core material is coated with a coating layer forming solution obtained by dissolving the foregoing coating resin and, according to the requirements, various additives in a proper solvent. There is no particular limitation to the solvent, and appropriate solvent may be selected taking the coating resin to be used, coating aptitude, or the like into account.

Specific examples of the resin coating method include a dipping method in which the core material of the carrier is dipped in the coating layer forming solution, a spraying method in which the coating layer forming solution is sprayed on the surface of the core of the carrier, a fluidized bed method in which the coating layer forming solution is sprayed on the carrier core material floated by air flow and a kneader coater method in which the carrier core material and the coating layer forming solution are mixed in a kneader coater and then a solvent is removed.

The mixing ratio (weight ratio) of an electrostatic image developing toner according to an exemplary embodiment of the present invention to the above carrier in the two-component developer, that is, toner:carrier=about 1:100 or more and about 30:100 or less and preferably about 3:100 or more and about 20:100 or less.

(Image Formation Apparatus and Process Cartridge)

Next, an image formation apparatus and an image forming method according to an exemplary embodiment of the present invention will be explained. Although no particular limitation is imposed on the image formation apparatus and image forming method according to an exemplary embodiment of the present invention insofar as they use the above toner and the developer containing the toner, specifically, the following image formation apparatus and image forming method are preferable.

That is, an image formation apparatus according to an exemplary embodiment of the present invention is provided with an image support, a latent image forming device that forms an electrostatic latent image on the surface of the image support, a developing device that develops the electrostatic latent image formed on the surface of the image support to form a toner image by using a developer supported on a developer support, a transfer device that transfers the toner image formed on the surface of the image support to the surface of a transfer-receiving body and a fixing device that fixes (at least one of photo-fixing or thermally fixing) the toner image (at least one of a visible image and an invisible image) transferred to the surface of the transfer-receiving body, the apparatus using an electrostatic image developer containing at least an electrostatic image developing toner according to en exemplary embodiment of the present invention as the developer.

A method of forming an image according to en exemplary embodiment of the present invention is provided with a latent formation process of forming an electrostatic latent image on the surface of an image support, a developing process of forming a toner image by developing the electrostatic latent image formed on the image support by using a developer supported on a developer support, a transfer process of transferring the toner image formed on the surface of the image support to the surface of a transfer-receiving body, and a fixing process of fixing (at least one of photo-fixing or thermally fixing) the toner image (at least one of a visible image and an invisible image) transferred to the transfer-receiving body, the method using an electrostatic image developer containing at least an electrostatic image developing toner according to en exemplary embodiment of the present invention as the developer.

Each of the above steps may be carried out by any conventional method adopted in conventional image formation methods. Also, the method of forming an image according to an exemplary embodiment of the present invention may involve further steps other than the above steps, for example, a cleaning process for cleaning the surface of the latent image support.

As the image support, for example, an electrophotographic photosensitive material, dielectric recording body or the like may be used. In the case of using an electrophotographic photosensitive material, the surface of the electrophotographic photosensitive material is made to substantially uniformly charge by, for example, a Corotron charger or contact charger (charging process), and then exposed to light to form an electrostatic latent image (latent image forming process). The photosensitive material is then brought into contact with or brought close to a developing roller with a developer layer formed thereon to stick toner particles to the electrostatic latent image to form a toner image on the electrophotographic photosensitive material (developing process). The formed toner image is transferred to the surface of a transfer-receiving body such as paper by utilizing a Corotron charger or the like (transfer process). The toner image transferred to the surface of the transfer-receiving body is then fixed (thermally fixed or the like) by a fixing machine (fixing process) to form a final toner image.

FIG. 1 is a schematic view showing an example of the structure of an image formation apparatus used to form an image by an image forming method according to an exemplary embodiment of the present invention. An image formation apparatus 200 shown in FIG. 1 has a structure provided with an image support 201, a charger 202, an image writing unit 203, a rotary developing unit 204, a primary transfer roller 205, a cleaning blade 206, an intermediate transfer body 207, plural (three in the drawing) support rollers 208, 209 and 210, a secondary transfer roller 211 and the like.

The image support 201 is formed in a drum shape as a whole and is provided with a photosensitive layer on the outer peripheral surface of the drum body (on the surface of the drum). This image support 201 is formed in such a manner as to be rotatable in the direction of the arrow C in FIG. 1. The charger 202 serves to electrify the image support 201 substantially uniformly. The image writing unit 203 serves to form an electrostatic latent image by applying image light to the image support 201 charged substantially uniformly by the charger 202.

The rotary developing unit 204 includes four developing parts 204Y, 204M, 204C and 204K that receive yellow, magenta, cyan and black toners, respectively, and a developing part 204F that receives an invisible image toner. Because in this unit toners are used as the developer for forming an image, a yellow toner is received in the developing part 204Y, a magenta toner is received in the developing part 204M, a cyan toner is received in the developing part 204C and a black toner is received in the developing part 204K. In this rotary developing unit 204, the above five developing parts 204Y, 204M, 204C, 204K and 204F are circularly driven in this order such that they are brought into contact with and face the image support 201, to thereby transfer each toner to an electrostatic latent image corresponding to each color, thereby forming a visible toner image and an invisible toner image.

Here, developing parts other than the developing part 204F in the rotary developing unit 204 may be partly removed. The rotary developing unit may be one provided with four developing parts, that is, the developing part 204F, the developing part 204Y, the developing part 204M and the developing part 204C. Also, the developing parts for forming visible images may be changed to those receiving developers each having a desired color, for example, red, blue or green, upon use.

The primary transfer roller 205 serves to support the intermediate transfer body 207 by interposing it between the primary transfer roller 205 and the image support 201 to transfer (primary transfer) a toner image (visible toner image or invisible toner image) formed on the surface of the image support 201 to the outer peripheral surface of the intermediate transfer body 207 having an endless belt form. The cleaning blade 206 serves to clean the toner left on the surface of the image support 201 after the image is transferred. The intermediate transfer body 207 is stretched and hung by the plural support rollers 208, 209 and 210 which are in contact with the inside peripheral surface of the intermediate transfer body 207 and is supported in such a manner as to be circularly driven in the direction of the arrow D and in the reverse direction. The secondary transfer roller 211 serves to support recording paper (image output medium) conveyed in the direction of the arrow E by a paper conveying device (not shown), in such a manner that the recording paper is sandwiched between the secondary transfer roller 211 and the support roller 210 to transfer (secondary transfer) the toner image, that has been transferred to the outer peripheral surface of the intermediate transfer body 207, to the recording paper.

The image formation apparatus 200, in which toner images are formed one after another on the surface of the image support 201 and the toner images are transferred to the outer periphery of the intermediate transfer body 207 on top of each other, works in the following manner. That is, first, the image support 201 is circularly driven, the surface of the image support 201 is made to charge substantially uniformly by the charger 202, and then the image support 201 is irradiated with image light by the image writing unit 203 to form an electrostatic latent image. This electrostatic latent image is developed by the yellow developing part 204Y, and then the toner image is transferred to the outer peripheral surface of the intermediate transfer body 207 by the primary transfer roller 205. The yellow toner that is not transferred to the recording paper at this time, but left on the surface of the image support 201, is cleaned by the cleaning blade 206. The intermediate transfer body 207 with the yellow toner image formed on the outer peripheral surface thereof is moved circularly once in the direction opposite to the direction of the arrow D such that it is situated at the position where the next magenta toner image is laminated and transferred to the yellow toner image.

For each of the magenta, cyan and black toners in the subsequent process, the same operations as above, that is, electrification by the charger 202, the irradiation of image light by the image writing unit 203, the formation of a toner image by each of the developing parts 204M, 204C and 204K and the transfer of a toner image to the outer peripheral surface of the intermediate transfer body 207, are repeated one by one.

In this manner, a full-color image (visible toner image) in which four color toner images are overlapped on each other is formed on the outer peripheral surface of the intermediate transfer body 207. This full-color visible toner image is transferred collectively to the transfer-receiving body by the secondary transfer roller 211. Thus, a recording image made of a full-color visible image can be obtained on the image formation surface of the transfer-receiving body.

In FIG. 1, it is preferable to fix the toner image by heating at a temperature range from about 110° C. to about 200° C., and preferably about 110° C. to about 160° C., after the toner image is transferred to the surface of the transfer-receiving body by the secondary transfer roller 211.

Examples of the transfer-receiving body (recording material) to which the toner image is transferred may be plain paper, OHP sheets or the like used in electrophotographic system copying machines, printers or the like. In order to further improve the smoothness of the surface of the fixed image, the surface of the above transfer-receiving body is preferably as smooth as possible and for example, coated paper obtained by coating the surface of plain paper with a resin or the like and art paper for printing are preferably used.

With regard to the supply of a toner to be used in an image formation apparatus according to an exemplary embodiment of the present invention, only a toner may be supplied or a toner may be supplied by exchanging a cartridge which contains a supply toner and is installed in the developing part of the image formation apparatus or in its vicinity in a detachable manner.

Any conventional material may be used as the cartridge without any problem, and examples of these conventional materials include polystyrene, acryl resins, polystyrene/acryl copolymers, ABS resins, polycarbonate resins, polypropylene resins, polyethylene resins, polyester resins, acrylonitrile resins and PET resins. Among these materials, preferable examples include polystyrene, acryl resins, polystyrene/acryl copolymers, ABS resins and polycarbonate resins from the viewpoint of strength, processability, stability and the like. Also, structural materials such as conventional metal materials, paper and nonwoven fabrics may be used without any problem.

As the form of the cartridge, any of a cylinder form, column form, boxed form, bottle form, or a combined type of these forms and other forms may be used. An appropriate form may be selected from these forms in consideration of the layout of the inside of the image formation apparatus, exchangeability and fitting ability, feeding ability of supply toners or the like. An appropriate arrangement of the cartridges in the inside of the image formation apparatus may be selected from vertical arrangement, horizontal arrangement and the like in consideration of the layout of the inside of the image formation apparatus, exchangeability and fitting ability, feeding ability of supply toners or the like. In view of a highly integrated layout, along with the miniaturization of an image formation apparatus, it is preferable to adopt a cylinder form, column form, and a combined shape of a cylinder form and a boxed form as the shape of the cartridge and horizontal arrangement as the arrangement of the cartridge in the inside of the image formation apparatus, though the shape and arrangement of the cartridge are not limited to the above.

In an exemplary embodiment of the present invention, the cartridge may be a supply cartridge with a supply toner received therein or one containing a supply toner and carrier received therein. Also, a process cartridge further containing a photosensitive material drum and a developing roller therein may be adopted.

A process cartridge according to an exemplary embodiment of the present invention is one which is obtained by integrating process devices, for example, an image support, a developing device that develops an electrostatic latent image formed on the surface of the image support to form a toner image by using a developer, into a cartridge, and is fitted to the body of an image formation apparatus in a detachable manner. Then, as the developer, an electrostatic image developer containing at least an electrostatic image developing toner according to an exemplary embodiment of the present invention is used. The process cartridge may be further provided with, according to requirements, a charging device that is brought into contact with the image support to electrify the image support, and a cleaning device that cleans the toner left on the surface of the image support after the toner image has been transferred.

Figure 2:
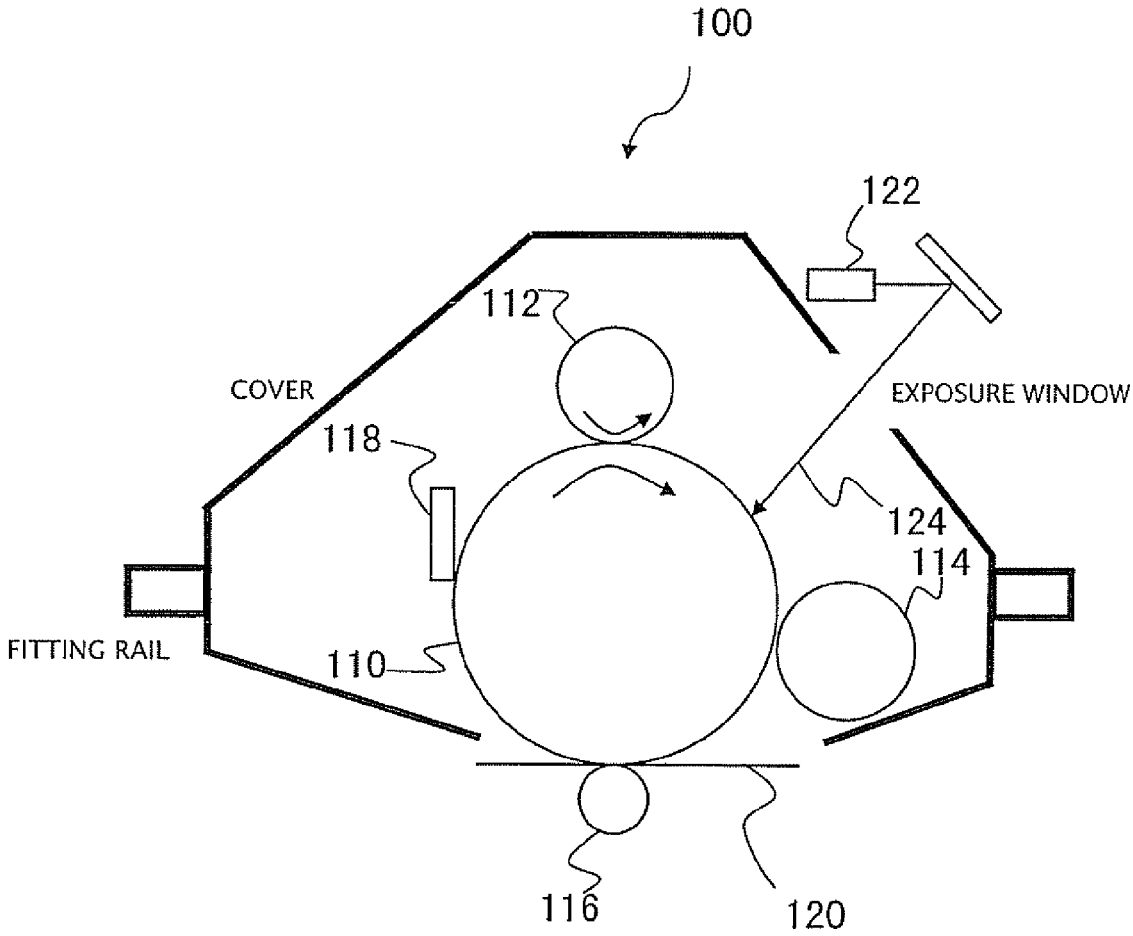
FIG. 2 is a schematic view showing a structural example of a process cartridge that forms an invisible image and a visible image according to an exemplary embodiment in the present invention.

The outline of an example of a process cartridge according to an exemplary embodiment of the present invention is shown in FIG. 2 to explain the structure of the process cartridge. In the process cartridge 100, an electrophotographic photosensitive material (photosensitive drum) as the image support on which an electrostatic latent image is formed, a charging roller 112 as a contact charging device that contact-electrifies the surface of the electrophotographic photosensitive material 110, a developing roller 114 as a developing device that sticks a toner to the electrostatic latent image formed on the surface of the electrophotographic photosensitive material 110 to form a toner image, and a cleaning blade 118 as the cleaning device that cleans the toner left on the electrophotographic photosensitive material 110 after the transfer operation is finished, are integrated and mounted on an image formation apparatus in a detachable manner. When the process cartridge is mounted on the image formation apparatus, the charging roller 112, an exposure device 122 used as a latent image forming device that forms a latent image on the surface of the electrophotographic photosensitive material 110 by laser light, reflected light from a manuscript or the like, the developing roller 114, a transfer roller 116 used as a transfer device that transfers the toner image formed on the surface of the electrophotographic photosensitive material 110 to the recording paper (recording sheet) 120 that is a transfer-receiving material, and the cleaning blade 119, are arranged in this order around the electrophotographic photosensitive material 110. In FIG. 2, the illustrations of functional units usually required in other electrophotographic processes are omitted.

(Method of Forming an Image by Using an Invisible Information Toner)

In the case of an invisible information pattern in a method of forming an image according to an exemplary embodiment of the present invention, only an invisible image is formed on the surface of a transfer-receiving body (image output medium) or a visible image is laminated on the invisible image formed on the surface of the transfer-receiving body, wherein at least any one of the invisible images is formed of a two-dimensional pattern and the invisible image is formed using an invisible information toner.

An invisible image formed in an exemplary embodiment of the present invention is printed using an invisible information toner, thereby enabling mechanical reading and decoding treatment by irradiation with infrared light stably for a long period of time and high-density recording of information. Also, this invisible image has almost no color developing ability and is therefore invisible in the visible region. Therefore, this invisible image may be formed in a desired region on the image forming surface whether or not a visible image is formed on the image forming surface of the image output medium.

In this case, the term "invisible image" means an image which can be recognized by a reading unit such as CCDs in the near-infrared region and can be almost unrecognized visually in the visible region (namely, invisible) because the electrostatic image developing toner forming the invisible image has almost no color developing ability derived from absorption of light having a specific wavelength in the visible light region.

The near-infrared absorbing agent to be used in the invisible information toner has a maximum absorption wavelength λmax falling in the near-infrared wavelength ranging preferably from about 800 nm to about 1200 nm and more preferably from about 850 nm or more to about 950 nm in consideration of a reading wavelength. With regard to the amount of light absorbed by the near-infrared absorbing agent, the amount of absorption at the above maximum wavelength λmax is preferably about 15% or more and more preferably about 20% or more.

The term "absorption coefficient" is given by the equation: Absorption coefficient (%)=100−(Toner image reflectance) (%) and the reflectance may be measured by a spectrophotometer (trade name: U-4000, manufactured by Hitachi Ltd.).

The near-infrared absorbing agent is preferably a phthalocyanine derivative or a naphthalocyanine derivative, and particularly the naphthalocyanine derivative taking into account that the maximum absorption wavelength λmax is in a range from about 800 nm to about 1200 nm. Moreover, the near-infrared absorbing agent is more preferably a substituted naphthalocyanine derivative having a substituent added thereto in consideration of reduced visible light absorption and easy accommodation to long wavelength. Specific examples of the near-infrared absorbing agent may include the following compounds.

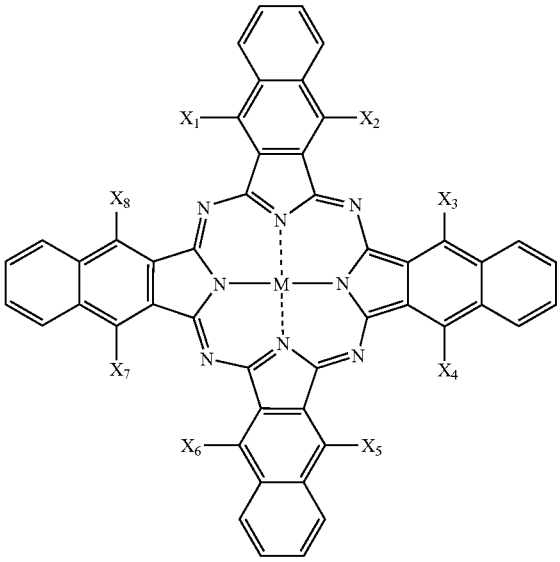

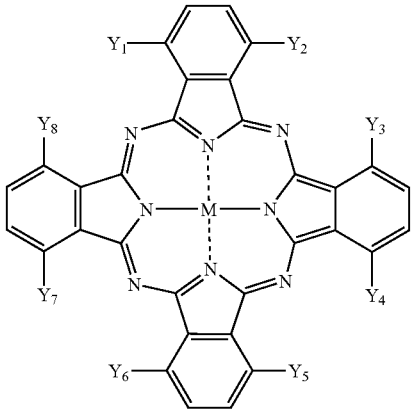

In the above naphthalocyanine compound and phthalocyanine compound, at least one of $X_1$ to $X_8$ and one of $Y_1$ and $Y_8$ are respectively an alkoxy group, an alkylthio group, a phenyl group and the like, with M representing a metal (or metal oxide) such as Cu, V(O), Zn, Ni or Pb. Also, other substituents such as a nitro group, amino group and the like may be introduced into parts other than $X_1$ to $X_8$ and $Y_1$ to $Y_8$.

As the materials other the near-infrared absorbing agent which are used in the invisible information toner, the same materials as those used in the above electrostatic image developing toner may be used. Also, the invisible information toner may be produced in the same manner as in the above electrostatic image developing toner by using the near-infrared absorbing agent as the colorant.

As the total amount of the near-infrared absorbing agent in the invisible information toner, the near-infrared absorbing agent is preferably about 0.1% by weight or more to about 10% by weight or less, and more preferably about 0.2% by weight or more to about 5% by weight or less, based on the total weight of the solid constituting the toner. When the amount of the near-infrared absorbing agent is less than about 0.1% by weight, there may be cases where sufficient absorption to read information is not obtained. When the amount of the near-infrared absorbing agent exceeds about 10% by weight, the color of the near-infrared absorbing agent may tend to be noticeable and there may be therefore a danger that not only is the color easily recognized visually but also, for example, the formation of a toner is difficult, or there may be a possibility that the near-infrared absorbing agent will not be dispersed very uniformly because the amount of the binder is relatively small when the toner is formed by kneading. Also, in the case of a toner to be used in combination with a usual colorant which is visible, the colorant may be contained in an amount of about 1% by weight or more and about 10% by weight or less, and preferably about 2% by weight or more and about 7% by weight or less based on the total weight of solid constituting the toner.

Also, the average dispersion diameter of the near-infrared absorbing agent in the invisible information toner is preferably about 1 μm or less and more preferably about 0.5 μm or less. When the average dispersion diameter exceeds about 1 μm, the color of the near-infrared absorbing agent may tend to be noticeable.

The invisible information toner has absorption in the infrared region. If a black toner using carbon black is used, the absorption wavelengths of the two may be overlapped in the infrared region, bringing about reading errors and deterioration in reproducibility, and therefore a carbon black-containing toner may not be used. For this reason, in the case of realizing a black color almost equal in blackness to that of carbon black, it is preferable to use a toner prepared by mixing three types of pigments, that is, cyan, magenta and yellow or process black obtained by a toner singly containing one of these pigments, or toner containing a perylene type compound, an anthraquinone type compound, cuttlefish ink or the like reduced in near-infrared absorption.

EXAMPLES

The invention will be explained in more detail by way of examples, but these examples should not be construed as limiting the scope of the invention.

First, each characteristic is measured as follows in the following examples.

<Method of Measuring Grain Size and Grain Size Distribution>

Explanations will be furnished as to grain diameter (also called "particle size", "particle diameter" or "grain size") and measurement of particle diameter distribution (also called "measurement of grain size distribution").

When the diameter of particles to be measured is 2 μm or more, Coultar Multisizer II type (manufactured by Beckman Coultar Inc.) is used as the measuring unit and ISOTON-II (manufactured by Beckman Coultar Inc.) is used as the electrolyte.

As to a measuring method, 0.5 to 50 mg of a sample to be measured is added in 2 ml of an aqueous 5% solution of sodium alkylbenzene sulfonate of a surfactant as the dispersant. The resulting solution is added to 100 ml of the electrolyte.

The electrolyte in which the sample is suspended is dispersed using an ultrasonic dispersing machine for about one minute and then subjected to the aforementioned Coultar Counter TA-II type using an aperture having an aperture diameter of 100 μm to measure the grain distribution of particles 2 to 60 μm in size, thereby finding the volume average distribution and a number average distribution, wherein the number of particles to be measured is 50,000.

The grain size distribution of the toner is found by the following method. In the measured grain size distribution, volume cumulative distributions for divided ranges (channel) of grain size are depicted from the smaller grain size side to define the cumulative volume particle diameter at which the accumulation of the distribution is 16%, as D16v and the accumulation of the distribution is 50%, as D50v. Furthermore, the cumulative volume particle diameter at which the accumulation of the distribution is 84% is defined as D84v.

At this time, D50v is set as a volume average particle diameter, and the index (GSDv) of volume average grain size distribution is calculated from the following equation.

$$GSDv=(D84v/D16v)^{1/2}.$$

Also, when the particle diameter to be measured is less than 2 μm, the grain size is measured by a laser diffraction type grain size distribution measuring device (trade name: LA-700, manufactured by HORIBA, Ltd.). Regarding the measuring method, the amount of the sample put in the dispersion solution is adjusted to about 2 g as a solid content. Ion exchange water is added to this dispersion solution to make the solution be a volume of about 40 ml. This solution is poured into a cell until the concentration becomes a desired value, and then allowed to stand for about 2 minutes to measure the grain size of the toner when the concentration in the cell is almost stable. The obtained volume average particle diameters in each channel are accumulated from a smaller volume particle diameter side, and a volume average particle diameter at which the accumulation is 50% is defined as the volume average particle diameter.

In the case of measuring powders such as external additives, 2 g of a measuring sample is added to 50 ml of an aqueous 5% solution of sodium alkylbenzene sulfonate of a surfactant, followed by dispersing the solution for 2 minutes using an ultrasonic dispersing machine (1,000 Hz) to prepare a sample which is measured in the same manner as in the case of the aforementioned dispersion solution.

<Method of Measuring the Shape Factor SF1 of the Toner>

The shape factor SF1 of the toner is a shape factor SF showing the degree of the irregularities of surface of the toner and calculated from the following equation.

$$SF1(ML^2/A)\times(\pi/4)\times100$$

In the above formula, ML represents the maximum length of the toner particles and A represents the projected area of the particle. The shape factor SF1 of the toner is measured in the following manner: an optical microscopic image of toners spread on a slide glass is taken in an image analyzer through a video camera to calculate each SF1 of 50 toners, and to then find an average.

<Method of Measuring the Molecular Weight and Molecular Weight Distribution of the Toner and Resin Particles>

The distribution of molecular weight is measured in the following condition. In GPC, a unit (trade name: HLC-8120GPC, SC-8020, manufactured by Tosoh Corporation) is used, two columns (trade name: TSK gel, Super HM-H, manufactured by Tosoh Corporation, 6.0 mm ID×15 cm) are used and THF (tetrahydrofuran) is used as the eluent. Experimental conditions are as follows: concentration of the sample: 0.5%, flow rate: 0.6 ml/min., amount of sample to be injected: 10 μl, measuring temperature: 40° C., using an IR detector to carry out experiment. Also, the calibration curve is made using 10 samples ("Polystyrene standard sample TSK standard": "A-500", "F-1", "F-10", "F-80", "F-380", "A-2500", "F-4", "F-40", "F-128" and "F-700".

<Method of Measuring the Melting Temperature and the Glass Transition Temperature of the Toner>

The melting temperature and glass transition temperature of the toner are determined by the DSC (differential scanning type calorimeter) measuring method and found from the primary maximum peak measured according to ASTMD 3418-8.

The primary maximum peak may be measured using DSC-7 manufactured by ParkinElmer. For the temperature calibration of the detective portion of this unit, the melting temperatures of both indium and zinc are used, and for the calibration of calories, the melting heat of indium is used. The sample was measured using an aluminum pan, an empty pan is set for the control and temperature rise rate is set to 10° C./min to measure.

<Method of Measuring the Acid Value of the Toner>

About 1 g of a resin is weighed accurately and dissolved in 80 mL of tetrahydrofuran. Phenolphthalein is added as the indicator to the solution to titrate using a 0.1 N KOH ethanol solution, which is added until the end point where the color of the solution is maintained for 30 seconds. The acid value (the amount in mg of KOH required to neutralize free fatty acid contained in 1 g of the resin, (according to JIS K0070: 92)) is calculated from the amount of the 0.1 N KOH ethanol solution to be used.

<Method of Measuring the Average Dispersion Particle Diameter of The Near-Infrared Absorbing Agent in the Toner>

1000 particulate near-infrared absorbing agents dispersed in the toner are observed by TEM (transmission type electron microscope) (tradename: JEM-1010, manufactured by JEOL DATUM LTD.) and the particle diameter of each particle is calculated from the sectional area of an individual particle to calculate an average of the obtained diameters.

<Maximum Absorption Wavelength of the Toner>

The spectrum of the toner image is measured using a spectrophotometer (trade name: U-4000, manufactured by Hitachi Ltd.) to calculate the maximum absorption wavelength and the amount of absorption (%) from the following equation: Maximum absorption wavelength and the amount of absorption (%)=Reflectance of the paper (%)−Reflectance of the toner image (%).

<Resin Coating Ratio of the Carrier>

This ratio is found by the following procedures.

(1) 10 g of a sample of the developer which is a subject of measurement is collected.

(2) A 50 mL beaker is charged with 10 g of the above sample and an aqueous 1% surfactant solution and shaken by an ultrasonic shaker for 5 minutes to carry out separation.

(3) After the shaking is finished, the system is allowed to stand for several minutes, and then the solution is thrown away while the sample in the beaker is retained by a magnet from the outside to collect only the carrier.

(4) The collected carrier is placed in a dryer to dry the carrier, thereby removing water.

(5) The dried carrier is placed in a 10 mm×10 mm aluminum cell of XPS (tradename: JPS80, manufactured by JEOL, Ltd.) to be measured. At this time, as the elements to be measured, each major component element of the resin coating film and core material is selected.

(6) The ratio of the numbers of the elements is calculated from the result of the measurement as the resin coating ratio.

<Synthesis of a Naphthalocyanine Type Compound>

(Synthesis of a Nitroisobutoxynaphthalocyanine Compound (Near-Infrared Absorbing Agent (1))

5.0 parts by weight of a compound represented by the following structural formula, 0.4 parts by weight of copper chloride (I), 2 mL of DBU and 25 mL of n-amyl alcohol are mixed and then stirred under refluxing for 6 hours. The reaction mixture is cooled to ambient temperature and poured into 100 mL of methanol to precipitate the compound, which is then filtered to obtain 3.43 parts by weight (yield: 65%) of β-tetranitro-octaisobutoxycopper naphthalocyanine (nitroisobutoxynaphthalocyanine compound) which is a naphthalocyanine compound represented by the above structural formula in which M is Cu and the substituents $X_1$ to $X_8$ are respectively an isobutoxy group (2-methylpropoxy group) and which has a nitro group at each β-position.

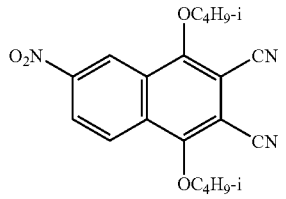

The above nitroisobutoxynaphthalocyanine compound has a maximum absorption wavelength ($\lambda_{max}$) of 860 nm and a gram absorption coefficient ($\epsilon_g$) of $1.02\times10^5$ mL/g·cm when it is dissolved in toluene. This compound is named a "near-infrared absorbing agent (1)".

(Synthesis of an Octabutoxynaphthalocyanine Compound (Near-Infrared Absorbing Agent (2))

10 parts by weight of a compound represented by the following structural formula, 0.921 parts by weight of copper chloride (I), 6.9 mL of DBU and 100 mL of n-amyl alcohol are mixed and then stirred under refluxing for 20 hours. The reaction mixture is cooled to ambient temperature and poured into 100 mL of methanol to precipitate the compound, which is then filtered to obtain 1.9 parts by weight (yield: 18%) of octanormalbutoxycopper naphthalocyanine which is a naphthalocyanine compound represented by the above structural formula in which M is Cu and the substituents $X_1$ to $X_8$ are respectively a normal butoxy group.

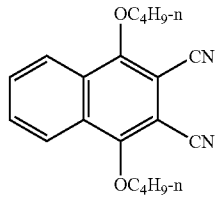

The above octanormalbutoxy naphthalocyanine compound has a maximum absorption wavelength ($\lambda_{max}$) of 850 nm and a gram absorption coefficient ($\in_g$) of $1.9\times10^5$ mL/g·cm when it is dissolved in toluene. This compound is named a "near-infrared absorbing agent (2)".

(Synthesis of a Vanadyloctathiophenylphthalocyanine Compound (Near-Infrared Absorbing Agent (3))

A vanadyloctathiophenylphthalocyanine compound is synthesized as outlined in the following document.

Name of the document: Campbell, James Stanley; Carr, Kathryn; Griffiths, Russell Jon WO2004020529 (AU 2003248995/EP 1537181/BR 200301367/CN1678691/JP 2005537319/US 2006000388)

CAS number 108210-59-9

The above vanadyloctathiophenylphthalocyanine compound has a maximum absorption wavelength ($\lambda_{max}$) of 830 nm and a gram absorption coefficient ($\epsilon_g$) of $1.7\times10^5$ mL/g·cm when it is dissolved in THF. This compound is named a "near-infrared absorbing agent (3)".

(Production of a Near-Infrared Absorbing Agent Particle Dispersion Solution (1))

10 parts by weight of the near-infrared absorbing agent (1), 1 part by weight of an anionic surfactant (trade name: Neogen R, DAI-ICHI KOGYO SEIYAKU Co., Ltd.) and 89 parts by weight of ion exchange water are mixed and the mixture is dispersed by an ultrasonic homogenizer (trade name: US-150T, manufactured by Nippon Seiki Co., Ltd.) at 150 W for 5 minutes to obtain a brown near-infrared absorbing agent particle dispersion solution (1) having a volume average particle diameter of 0.41 μm and a solid concentration of 11% by weight.

(Production of a Near-Infrared Absorbing Agent Particle Dispersion Solution (2))

The same procedures as above are conducted, except that the near-infrared absorbing agent (2) is used in place of the near-infrared absorbing agent (1) in the production of the near-infrared absorbing agent particle dispersion solution (1), to obtain a brown near-infrared absorbing agent particle dispersion solution (2) having a volume average particle diameter of 0.38 μm and a solid concentration of 11% by weight.

(Production of a Near-Infrared Absorbing Agent Particle Dispersion Solution (3))

The same procedures as above are conducted except that vanadyl naphthalocyanine (trade name: YKR-5010, manufactured by Yamamoto Chemicals, Inc., maximum absorption wavelength: 845 nm) is used in place of the near-infrared absorbing agent (1) in the production of near-infrared absorbing agent particle dispersion solution (1), to obtain a green near-infrared absorbing agent particle dispersion solution (3) having a volume average particle diameter of 0.3 μm and a solid concentration of 11% by weight.

(Production of a Near-Infrared Absorbing Agent Particle Dispersion Solution (4))

The same procedures as above are conducted except that tetraphenylvanadylnaphthalocyanine (manufactured by Sigma-Ardlich) is used in place of the near-infrared absorbing agent (1) in the production of near-infrared absorbing agent particle dispersion solution (1), to obtain a green near-infrared absorbing agent particle dispersion solution (4) having a volume average particle diameter of 0.32 Mm and a solid concentration of 11% by weight.

(Production of a Near-Infrared Absorbing Agent Particle Dispersion Solution (5))

The same procedures as above are conducted except that the near-infrared absorbing agent (3) is used in place of the near-infrared absorbing agent (1) in the production of the near-infrared absorbing agent particle dispersion (1), to obtain a brown near-infrared absorbing agent particle dispersion solution (5) having a volume average particle diameter of 0.28 μm and a solid concentration of 20% by weight.

(Production of an Additive Particle Dispersion Solution (1))

10 parts by weight of 1-phenylpyrrole (melting temperature: 60° C., manufactured by Wako Pure Chemical Industries, Ltd.) having the following structural formula, 1 part by weight of an anionic surfactant (Neogen R, manufactured by DAI-ICHI KOGYO SEIYAKU Co., Ltd.) and 89 parts by weight of ion exchange water are mixed and the mixture is dispersed by an ultrasonic homogenizer (trade name: US-150T, manufactured by Nippon Seiki Co., Ltd.) at 150 W for 5 minutes to obtain a white additive particle dispersion solution (1) having a volume average particle diameter of 0.51 μm and a solid concentration of 11% by weight.

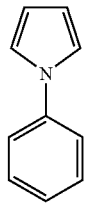

(Production of an Additive Particle Dispersion Solution (2))

The same procedures as above are conducted except that 1-(4-chlorophenyl)-1H-pyrrole (melting temperature: 88° C., manufactured by Kanto Chemical Co., Inc.) having the following structural formula is used in place of 1-phenylpyrrole in the production of the additive particle dispersion solution (1), to obtain a white additive particle dispersion solution (2) having a volume average particle diameter of 0.38 μm and a solid concentration of 11% by weight.

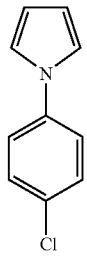

(Production of an Additive Particle Dispersion Solution (3))

The same procedures as above are conducted except that 3-acetyl-2,4-dimethylpyrrole (melting temperature: 136° C., manufactured by Kanto Chemical Co., Inc) having the following structural formula is used in place of 1-phenylpyrrole in the production of the additive particle dispersion solution (1), to obtain a white additive particle dispersion solution (3) having a volume average particle diameter of 0.40 μm and a solid concentration of 11% by weight.

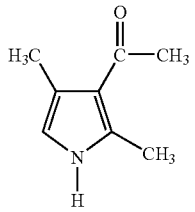

(Production of an Additive Particle Dispersion Solution (4))

10 parts by weight of 2-ethylimidazole (melting temperature 76° C., manufactured by Wako Pure Chemical Industries, Ltd.) having the following structural formula, 1 part by weight of an anionic surfactant (Neogen R, manufactured by DAI-ICHI KOGYO SEIYAKU Co., Ltd.) and 89 parts by weight of ion exchange water are mixed and the mixture is dispersed by an ultrasonic homogenizer (trade name: US-150T, manufactured by Nippon Seiki Co., Ltd.) at 150 W for 5 minutes to obtain a white additive particle dispersion solution (4) having a volume average particle diameter of 0.35 μm and a solid concentration of 11% by weight.

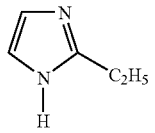

(Production of an Additive Particle Dispersion Solution (5))

The same procedures as above are conducted except that ethyl 3-methyl-5-pyrazolecarboxylate (melting temperature: 80° C., manufactured by Wako Pure Chemical Industries, Ltd.) having the following structural formula is used in place of 2-ethylimidazole in the production of the additive particle dispersion solution (4), to obtain a white additive particle dispersion solution (5) having a volume average particle diameter of 0.4 μm and a solid concentration of 11% by weight.

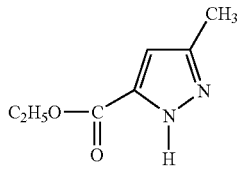

(Production of an Additive Particle Dispersion Solution (6))

The same procedures as above are conducted except that benzimidazole (melting temperature: 170° C., manufactured by Wako Pure Chemical Industries, Ltd.) having the following structural formula is used in place of 2-ethylimidazole in the production of the additive particle dispersion solution (4), to obtain a white additive particle dispersion solution (6) having a volume average particle diameter of 0.42 μm and a solid concentration of 11% by weight.

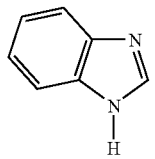

(Production of an Additive Particle Dispersion Solution (7))

The same procedures as above are conducted except that 2,4,5-triphenylimidazole (melting temperature: 274° C., manufactured by Wako Pure Chemical Industries, Ltd.) is used in place of 2-ethylimidazole in the production of the additive particle dispersion solution (4), to obtain a white additive particle dispersion solution (7) having a volume average particle diameter of 0.55 μm and a solid concentration of 11% by weight.

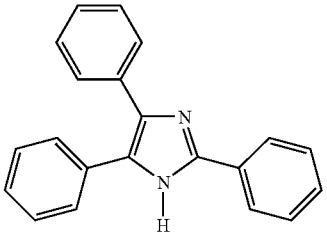

(Production of an Additive Particle Dispersion Solution (8))

10 parts by weight of 2-phenyl-2-imidazoline (melting temperature: 95° C., manufactured by Wako Pure Chemical Industries, Ltd.) having the following structural formula, 1 part by weight of an anionic surfactant (Neogen R, manufactured by DAI-ICHI KOGYO SEIYAKU Co., Ltd.) and 99 parts by weight of ion exchange water are mixed, and the mixture is dispersed by an ultrasonic homogenizer (trade name: US-150T, manufactured by Nippon Seiki Co., Ltd.) at 150 W for 5 minutes to obtain a white additive particle dispersion solution (8) having a volume average particle diameter of 0.30 μm and a solid concentration of 11% by weight.

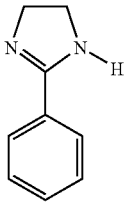

(Production of an Additive Particle Dispersion Solution (9))

The same procedures as above are conducted except that 3-methyl-1-phenyl-2-pyrazolin-5-one (melting temperature: 130° C., manufactured by Wako Pure Chemical Industries, Ltd.) having the following structural formula is used in place of 2-phenyl-2-imidazoline in the production of the additive particle dispersion solution (8), to obtain a white additive particle dispersion solution (9) having a volume average particle diameter of 0.35 μm and a solid concentration of 11% by weight.

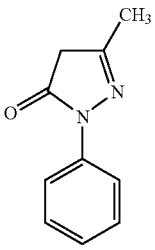

(Production of an Additive Particle Dispersion Solution (10))

The same procedures as above are conducted except that 2-(nitroimino)-imidazolidine (melting temperature: 220° C., manufactured by Wako Pure Chemical Industries, Ltd.) having the following structural formula is used in place of 2-phenyl-2-imidazoline in the production of the additive particle dispersion solution (8), to obtain a white additive particle dispersion solution (10) having a volume average particle diameter of 0.38 μm and a solid concentration of 11% by weight.

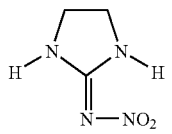

(Production of an Additive Particle Dispersion Solution (11))

The same procedures as above are conducted except that 1-(2-chlorophenyl)-imidazolin-2-thione (melting temperature: 246° C., manufactured by Wako Pure Chemical Industries, Ltd.) having the following structural formula is used in place of 2-phenyl-2-imidazoline in the production of the additive particle dispersion solution (8), to obtain a white additive particle dispersion solution (11) having a volume average particle diameter of 0.40 μm and a solid concentration of 11% by weight.

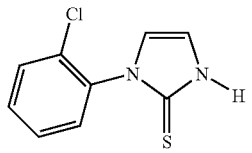

(Production of an Additive Particle Dispersion Solution (12))

The same procedures as above are conducted except that 1-phenyl-4-methyl-4-phenylmethylpyrazolidine-3-thione (melting temperature: 133° C., synthesized with reference to JP7-157471A) having the following structural formula is used in place of 2-phenyl-2-imidazoline in the production of the additive particle dispersion solution (8), to obtain a slightly yellowish additive particle dispersion solution (12) having a volume average particle diameter of 0.30 μm and a solid concentration of 11% by weight.

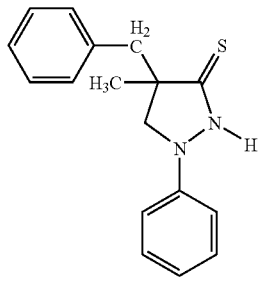

(Production of an Additive Particle Dispersion Solution (13))

10 parts by weight of 3-(tert-butoxycarbonylamino)-pyrrolidine (melting temperature 54° C., manufactured by Tokyo Chemical Industry Co., Ltd.) having the following structural formula, 1 part by weight of an anionic surfactant (Neogen R, manufactured by DAI-ICHI KOGYO SEIYAKU Co., Ltd.) and 89 parts by weight of ion exchange water are mixed and the mixture is dispersed by an ultrasonic homogenizer (trade name: US-150T, manufactured by Nippon Seiki Co., Ltd.) at 150 W for 5 minutes to obtain a white additive particle dispersion solution (13) having a volume average particle diameter of 0.29 μm and a solid concentration of 11% by weight.

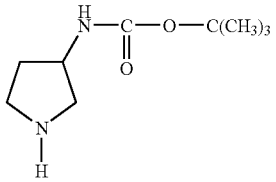

(Production of an Additive Particle Dispersion Solution (14))

The same procedures as above are conducted except that 1-benzyl-3-(trifluoroacetamide)-pyrrolidine (melting temperature: 71° C., manufactured by Tokyo Chemical Industry Co., Ltd.) having the following structural formula is used in place of 3-(tert-butoxycarbonylamino)-pyrrolidine in the production of the additive particle dispersion solution (13), to obtain a white additive particle dispersion solution (14) having a volume average particle diameter of 0.32 μm and a solid concentration of 11% by weight.

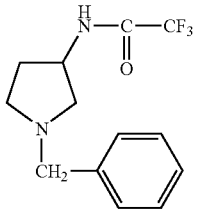

(Production of an Additive Particle Dispersion Solution (15))

The same procedures as above are conducted except that 1-benzyl-3-(tert-butoxycarbonylamino)-pyrrolidine (melting temperature: 113° C., manufactured by Tokyo Chemical Industry Co., Ltd.) having the following structural formula is used in place of 3-(tert-butoxycarbonylamino)-pyrrolidine in the production of the additive particle dispersion solution (13), to obtain a white additive particle dispersion solution (15) having a volume average particle diameter of 0.35 μm and a solid concentration of 11% by weight.

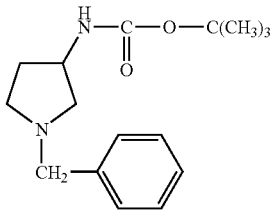

(Production of an Additive Particle Dispersion Solution (16))

The same procedures as above are conducted except that 2,2,5,5-tetramethyl-3-pyrrolidinecarboxamide (melting temperature: 131° C., manufactured by Kanto Chemical Co., Inc) having the following structural formula is used in place of 3-(tert-butoxycarbonylamino)-pyrrolidine in the production of the additive particle dispersion solution (13), to obtain a white additive particle dispersion solution (16) having a volume average particle diameter of 0.39 μm and a solid concentration of 11% by weight.

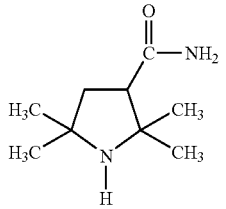

(Production of an Additive Particle Dispersion Solution (17))

10 parts by weight of 5-(ethylthio)-1H-tetrazole (melting temperature: 84° C., manufactured by Wako Pure Chemical Industries, Ltd.) having the following structural formula, 1 part by weight of an anionic surfactant (Neogen R, manufactured by DAI-ICHI KOGYO SEIYAKU Co., Ltd.), and 89 parts by weight of ion exchange water are mixed and the mixture is dispersed by an ultrasonic homogenizer (trade name: US-150T, manufactured by Nippon Seiki Co., Ltd.) at 150 W for 5 minutes to obtain a white additive particle dispersion solution (17) having a volume average particle diameter of 0.50 μm and a solid concentration of 11% by weight.

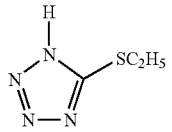

(Production of an Additive Particle Dispersion Solution (18))

The same procedures as above are conducted except that 5-chloro-1-phenyltetrazole (melting temperature: 122° C., manufactured by Wako Pure Chemical Industries, Ltd.) having the following structural formula is used in place of 5-(ethylthio)-1H-tetrazole in the production of the additive particle dispersion solution (17), to obtain a white additive particle dispersion solution (18) having a volume average particle diameter of 0.40 μm and a solid concentration of 11% by weight.

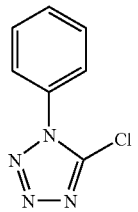

(Production of an Additive Particle Dispersion Solution (19))

The same procedures as above are conducted except that 5-(4-methylphenyl)-1H-tetrazole (melting temperature: 250° C., manufactured by Wako Pure Chemical Industries, Ltd.) having the following structural formula is used in place of 5-(ethylthio)-1H-tetrazole in the production of the additive particle dispersion solution (17), to obtain a white additive particle dispersion solution (19) having a volume average particle diameter of 0.45 μm and a solid concentration of 11% by weight.

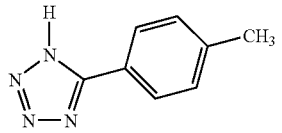

(Preparation of a Releasing Agent Particle Dispersion Solution (Hereinafter, Also Referred to as "Releasing Agent Dispersion Solution") (1)

46 parts by weight of paraffin wax (trade name: HNPO 190, manufactured by Nippon Seiro Co., Ltd., melting temperature: 85° C.), 4 parts by weight of an anionic surfactant (trade name: Dowfax, manufactured by The Dow Chemical Company) and 200 parts by weight of ion exchange water are heated to 96° C. The heated mixture is dispersed using a homogenizer (trade name: Ultra Talax T50, manufactured by IKA company) at 3000 rpm for 1 hour, and then subjected to a pressure ejecting type homogenizer (trade name: Gaulin Homogenizer, manufactured by Gaulin company) to carry out dispersing treatment, to obtain a releasing agent dispersion solution (1) having a center diameter of 150 nm and a solid content of 20.0% by weight.

(Preparation of a Resin Particle Dispersion Solution)

550 parts by weight of styrene, 60 parts by weight of n-butylacrylate, 15 parts by weight of acrylic acid and 10 parts by weight of dodecanethiol are mixed to dissolve, to thereby prepare a monomer solution.

14 parts by weight of an anionic surfactant (trade name: Dowfax, manufactured by The Dow Chemical Company) is dissolved in 250 parts by weight of ion exchange water, to which is added the foregoing monomer solution and the mixture is dispersed to emulsify the solution in a flask (monomer emulsion A). Furthermore, 1 part by weight of the same anionic surfactant (trade name: Dowfax, manufactured by The Dow Chemical company) is dissolved in 555 parts by weight of ion exchange water, which is then transferred to a polymerizing flask. The polymerizing flask is sealed with a lid and a refluxing tube is installed. Nitrogen is injected into the polymerizing flask, which is then heated and retained in a water bath until the temperature is raised up to 95° C. with slow stirring. 9 parts by weight of ammonium persulfate is dissolved in 43 parts by weight of ion exchange water and the resulting solution is added dropwise into the polymerizing flask by a constant volume delivery pump over 20 minutes. Then, the monomer emulsion A is again added dropwise into the flask by a constant volume delivery pump over 200 minutes. After that, the polymerizing flask is kept at 95° C. for 3 hours with slow stirring continuously to terminate the polymerization. An anionic resin particle dispersion solution having a volume average particle diameter of 200 nm, a glass transition temperature of 56° C., and acid value of 25 mg KOH/g, a weight average molecular weight of 31,000, and a solid content of 40% is thereby obtained.

Example 1

Production of a Toner 200 parts by weight of a resin particle dispersion solution (resin content: 80 parts by weight), 15 parts by weight of the near-infrared absorbing agent particle dispersion solution (1) (particle content: 1.5 parts by weight), 60 parts by weight of the additive particle dispersion solution (1) (particle content: 6 parts by weight), 50 parts by weight of the releasing agent particle dispersion solution (releasing agent content: 10 parts by weight) and 0.15 parts by weight of aluminum polychloride are poured into a stainless steel flask having a round bottom, and dispersed. The mixture in the flask is then heated to 50° C. in a heating oil bath with stirring, and then kept at this temperature for 90 minutes. Then, 250 parts by weight of a resin particle dispersion solution is further added to the mixture over 15 minutes. Thereafter, the pH in the system is adjusted to 5.4 by addition of 0.5 mol/L of an aqueous sodium hydroxide solution, and the stainless steel flask is tightly closed, followed by heating the mixture up to 95° C. with stirring continuously by using a magnetic seal, and then kept at that temperature for 5 hours.

After the reaction is finished, the reaction mixture is cooled, filtered, washed sufficiently with ion exchange water, and then subjected to Nutsche type suction filtration to carry out solid-liquid separation. The solid is redispersed in 3 L of 40° C. ion exchange water, which is then stirred at 300 rpm for 15 minutes for washing. This washing operation is further repeated five times, and then the washed mixture is subjected to solid-liquid separation by Nutsche type suction filtration using No. 5A filter paper when the pH of the filtrate becomes 7.01. Then, the solid is continuously dried under vacuum for 12 hours to obtain toner particles (1).

The particle diameter of the toner particles (1) is measured, to find that the toner has a volume average particle diameter D50v of 5.71 μm and an index GSDv of volume average grain size distribution of 1.22. Also, the toner particle has a shape factor SF1 of 130 and a potato-like form when its shape is observed by a Ruzeks image analyzer. Also, the average dispersion diameter of the naphthalocyanine type compound in the toner is 0.52 μm and the maximum absorption wavelength of the toner is 870 nm.

(Preparation of a Developer (1))

1.2 parts by weight of hydrophobic silica (trade name: TS720, manufactured by Cabot Corporation) is added to 50 parts by weight of the above toner particles (1) and these components are mixed in a sample mill to obtain an external additive toner (1). Then, a ferrite carrier coated with 1% (wt % based on the toner) of polymethylmethacrylate (manufactured by Soken Chemical & Engineering Co., Ltd.) and having a volume average particle diameter of 50 μm is used and the external additive toner (1) is weighed such that the concentration of the toner is 5% (wt % based on the developer). The two are mixed with stirring for 5 minutes in a ball mill to prepare a developer (1). The resin coating ratio of the carrier is 85% based on the surface of the carrier.

<Evaluation of the Toner Particle>

(Test for Near-Infrared Ray-Absorbing Amount of the Toner)

In an image formation test, a remodeled machine of Docu Color Centre 500CP manufactured by Fuji Xerox Co., Ltd. is used as the image formation apparatus. Also, as the recording medium used in the image formation test, an A-4 size white paper (J-paper-A4, manufactured by Fuji Xerox Co., Ltd., width: 210 mm, length: 297 mm) is used.

Using the developer (1), an image is formed on the surface of an image output medium by an image formation apparatus. The resulting image is subjected to a spectrophotometer (trade name: U-4000, manufactured by Hitachi, Ltd.) used to measure the reflectance of the image. The amount of light to be absorbed is calculated based on the following equation from the reflectance at $\lambda_{max}$ (near-infrared wavelength region). The results are shown in Table 1.

Absorptance (%)=100−(Reflectance of a toner image) (%)

(Evaluation of Restoring Rate of Invisible Information)

In the evaluation of restoring rate of invisible information, the image formation surface of a record 1 is irradiated with a ring-shaped LED light source (trade name: LEB-3012CE, manufactured by Kyoto Denkiki Co., Ltd.) including light falling in the near-infrared wavelength region from 800 nm to 1200 nm, the light source being located almost directly above and at a distance of 10 cm from the image formation surface. In this state, a CCD camera (trade name: CCD TL-C2, manufactured by Keyence Corporation) that has light sensitivity in a wavelength region from 800 nm to 1000 nm and is equipped with a filter in its lens section which cuts a component of wavelengths of 800 nm or less is located about 15 cm apart from and almost directly above the image formation surface, to read the information on the above image formation surfacer thereby extracting an invisible image by binary digital processing using a specified contrast (threshold value) as its border. The extracted invisible image is subjected to decoding processing conducted by software, to thereby confirm whether or not the copy light information can be restored for evaluation. Then, in this evaluation, the above process is repeated 500 times to measure the number of operations in which the information is exactly restored as the restoring rate (%) of invisible information as shown in Table 2. If the restoring rate (%) of invisible information is 80% or more, and preferably 85% or more, this is defined as a level that gives rise to no practical problem.

(Visible Evaluation of Invisible Information)

The visibility of the invisible information by visual observation is evaluated according to the following standard by using X-Rite to measure L*.

A: $L^* \geq 95$

B: $93 \leq L^* < 95$

C: $91 \leq L^* < 93$

D: $L^* < 91$ (Test for Light Fastness)

A test for detecting the light fastness of the formed image is performed using Sun Test CPS+(trade name, manufactured by Toyo Seiki Seisaku-Sho, Ltd.) under the conditions of light irradiation times of 0 hour and 48 hours, wherein X-Rite is used to measure L*, thereby calculating a difference between the above L*s to evaluate the image according to the following standard.

A: $L^* < 1$

B: $1 \leq L^* < 2$

C: $2 \leq L^* < 3$

D: $L^* \geq 3$

Example 2

Toner particles (2), an external additive toner (2) and a developer (2) are obtained in the same manner as in Example 1 except that the near-infrared absorbing agent particle dispersion solution (2) is used in place of the near-infrared absorbing agent particle dispersion solution (1). Also, the evaluation tests are carried out in the same manner as in Example 1. The results are shown in Table 1.

Example 3

Toner particles (3), an external additive toner (3) and a developer (3) are obtained in the same manner as in Example 1 except that the near-infrared absorbing agent particle dispersion solution (3) is used in place of the near-infrared absorbing agent particle dispersion solution (1). Also, the evaluation tests are carried out in the same manner as in Example 1. The results are shown in Table 1.

Example 4

Toner particles (4), an external additive toner (4) and a developer (4) are obtained in the same manner as in Example 1 except that the near-infrared absorbing agent particle dispersion solution (4) is used in place of the near-infrared absorbing agent particle dispersion solution (1). Also, the evaluation tests are carried out in the same manner as in Example 1. The results are shown in Table 1.

Example 5

Toner particles (5), an external additive toner (5) and a developer (5) are obtained in the same manner as in Example 1 except that the near-infrared absorbing agent particle dispersion solution (5) is used in place of the near-infrared absorbing agent particle dispersion solution (1). Also, the evaluation tests are carried out in the same manner as in Example 1. The results are shown in Table 1.

Example 6

Toner particles (6), an external additive toner (6) and a developer (6) are obtained in the same manner as in Example 1 except that the near-infrared absorbing agent particle dispersion solution (3) is used in place of the near-infrared absorbing agent particle dispersion solution (1) and the additive particle dispersion solution (2) is used in place of the additive particle dispersion solution (1). Also, the evaluation tests are carried out in the same manner as in Example 1. The results are shown in Table 1.

Example 7

Toner particles (7), an external additive toner (7) and a developer (7) are obtained in the same manner as in Example 1 except that the near-infrared absorbing agent particle dispersion solution (3) is used in place of the near-infrared absorbing agent particle dispersion solution (1) and the additive particle dispersion solution (3) is used in place of the additive particle dispersion solution (1). Also, the evaluation tests are carried out in the same manner as in Example 1. The results are shown in Table 1.

Example 8

A mixture of 89 parts by weight of linear polyester (linear polyester obtained from terephthalic acid/bisphenol A-ethylene oxide addition product/cyclohexane dimethanol, Tg=62° C., number average molecular weight Mn=4,000, weight average molecular weight Mw=35,000, acid value=12, hydroxyl value=25), 0.8 parts by weight of phenylvanadylnaphthalocyanine, 3 parts by weight of 1-phenylpyrrole and 5 parts by weight of polyethylene wax (melting temperature 135° C.) is kneaded in an extruder and milled by a milling machine. The milled mixture is subjected to a pneumatic classifier to separate particles having an intermediate diameter from fine particles and coarse particles, and this process is repeated three times to obtain toner particles (8), an external additive toner (8) and a developer (8). Also, the evaluation tests are carried out in the same manner as in Example 1. The results are shown in Table 1.

Example 9

Toner particles (9), an external additive toner (9) and a developer (9) are obtained in the same manner as in Example 1 except that the near-infrared absorbing agent particle dispersion solution (3) is used in place of the near-infrared absorbing agent particle dispersion solution (1) and the additive amount of the additive particle dispersion solution (1) is changed to 1.5 parts by weight (the content of particle: 0.15 parts by weight) from 60 parts by weight. Also, the evaluation tests are carried out in the same manner as in Example 1. The results are shown in Table 1.

Example 10

Toner particles (10), an external additive toner (10) and a developer (10) are obtained in the same manner as in Example 1 except that the near-infrared absorbing agent particle dispersion solution (3) is used in place of the near-infrared absorbing agent particle dispersion solution (1) and the additive amount of the additive particle dispersion solution (1) is changed to 120 parts by weight (the content of particle: 12 parts by weight) from 60 parts by weight. Also, the evaluation tests are carried out in the same manner as in Example 1. The results are shown in Table 1.

Example 11

A developer (11) is obtained in the same manner as in Example 3 except that the amount of the polymethylmethacrylate to be used to coat the carrier is changed to 0.8% (wt % based on the toner). The resin coating ratio of the carrier is 45% based on the surface of the carrier. Also, the evaluation tests are carried out in the same manner as in Example 1. The results are shown in Table 1.

Example 12

A developer (12) is obtained in the same manner as in Example 3 except that the amount of the polymethylmethacrylate to be used to coat the carrier is changed to 1.2% (wt % based on the toner). The resin coating ratio of the carrier is 75% based on the surface of the carrier. Also, the evaluation tests are carried out in the same manner as in Example 1. The results are shown in Table 1.

Example 13

A developer (13) is obtained in the same manner as in Example 3 except that the amount of the polymethylmethacrylate to be used to coat the carrier is changed to 2% (wt % based on the toner). The resin coating ratio of the carrier is 95% based on the surface of the carrier. Also, the evaluation tests are carried out in the same manner as in Example 1. The results are shown in Table 1.

Example 14

A developer (14) is obtained in the same manner as in Example 3 except that the amount of the polymethylmethacrylate to be used to coat the carrier is changed to 3% (wt % based on the toner). The resin coating ratio of the carrier is 98% based on the surface of the carrier. Also, the evaluation tests are carried out in the same manner as in Example 1. The results are shown in Table 1.

Comparative Example 1

Toner particles (75), an external additive toner (75) and a developer (75) are obtained in the same manner as in Example 1 except that the near-infrared absorbing agent particle dispersion solution (3) is used in place of the near-infrared absorbing agent particle dispersion solution (1) and the additive particle dispersion solution (1) is not used. Also, the evaluation tests are carried out in the same manner as in Example 1. The results are shown in Table 1.

TABLE 1

| | Near-infrared absorbing agent particle dispersion solution | Additive particle dispersion solution and amount | Toner D50v [μm] | GSDv | SF1 | Average dispersion diameter [μm] | Toner λ max [nm] | Resin coating ratio of the carrier [%] | Amount of absorption of light at λ max | Restoring rate (%) of invisible information | Visibility by visual observation | Test for light fastness |
|---|---|---|---|---|---|---|---|---|---|---|---|---|
| Example 1 | (1) | (1) 6 parts by weight | 5.71 | 1.22 | 130 | 0.57 | 870 | 85 | 34 | 92 | C | C |
| Example 2 | (2) | (1) 6 parts by weight | 5.68 | 1.21 | 130 | 0.58 | 860 | 85 | 32 | 91 | C | C |
| Example 3 | (3) | (1) 6 parts by weight | 5.72 | 1.22 | 131 | 0.55 | 850 | 85 | 38 | 94 | B | B |
| Example 4 | (4) | (1) 6 parts by weight | 5.65 | 1.20 | 130 | 0.57 | 855 | 85 | 41 | 95 | A | B |
| Example 5 | (5) | (1) 6 parts by weight | 5.70 | 1.21 | 129 | 0.6 | 840 | 85 | 35 | 92 | C | B |
| Example 6 | (3) | (2) 6 parts by weight | 5.69 | 1.20 | 129 | 0.58 | 850 | 85 | 35 | 92 | C | B |
| Example 7 | (3) | (3) 6 parts by weight | 5.63 | 1.22 | 132 | 0.62 | 850 | 85 | 30 | 90 | C | A |
| Example 8 | Particles of (3) | Particles of (1) | 9.60 | 1.40 | 149 | 0.65 | 850 | 85 | 22 | 82 | C | B |
| Example 9 | (3) | (1) 0.15 parts by weight | 5.70 | 1.21 | 132 | 0.66 | 850 | 85 | 18 | 77 | C | A |
| Example 10 | (3) | (1) 12 parts by weight | 5.72 | 1.22 | 130 | 0.49 | 850 | 85 | 48 | 98 | C | C |
| Example 11 | (3) | (1) 6 parts by weight | 5.72 | 1.22 | 131 | 0.55 | 850 | 45 | 26 | 82 | A | B |
| Example 12 | (3) | (1) 6 parts by weight | 5.72 | 1.22 | 131 | 0.55 | 850 | 75 | 30 | 90 | C | B |
| Example 13 | (3) | (1) 6 parts by weight | 5.72 | 1.22 | 131 | 0.55 | 850 | 95 | 38 | 94 | C | B |
| Example 14 | (3) | (1) 6 parts by weight | 5.72 | 1.22 | 131 | 0.55 | 850 | 98 | 31 | 90 | C | B |
| Comparative Example 1 | (3) | — | 5.71 | 1.19 | 128 | 0.7 | 850 | 85 | 18 | 75 | D | A |

As mentioned above, since a nitrogen-containing type additive is contained in the near-infrared absorbing agent-containing toner, the electrostatic image developing toners of Examples 1 to 14 can be made to have significantly increased amount of absorption of near-infrared rays compared to conventional near-infrared absorbing agent-containing toners, and can be improved in invisible information restoring rate. Also, since a nitrogen-containing type additive is contained in the near-infrared absorbing agent-containing toner, the electrostatic image developing toners of Examples 1 to 14 can be improved in the dispersion of the near-infrared absorption agent, and invisible information is viewed visually with more difficulty than in the case of using conventional near-infrared absorbing agent-containing toners.

Example 15

Toner particles (15), an external additive toner (15) and a developer (15) are obtained in the same manner as in Example 1 except that the additive particle dispersion solution (4) is used in place of the additive particle dispersion solution (1) Also, the evaluation tests are carried out in the same manner as in Example 1. The results are shown in Table 2.

Example 16

Toner particles (16), an external additive toner (16) and a developer (16) are obtained in the same manner as in Example 15 except that the near-infrared absorbing agent particle dispersion solution (2) is used in place of the near-infrared absorbing agent particle dispersion solution (1). Also, the evaluation tests are carried out in the same manner as in Example 1. The results are shown in Table 2.

Example 17

Toner particles (17), an external additive toner (17) and a developer (17) are obtained in the same manner as in Example 15 except that the near-infrared absorbing agent particle dispersion solution (3) is used in place of the near-infrared absorbing agent particle dispersion solution (1). Also, the evaluation tests are carried out in the same manner as in Example 1. The results are shown in Table 2.

Example 18

Toner particles (1), an external additive toner (18) and a developer (18) are obtained in the same manner as in Example 15 except that the near-infrared absorbing agent particle dispersion solution (4) is used in place of the near-infrared absorbing agent particle dispersion solution (1). Also, the evaluation tests are carried out in the same manner as in Example 1. The results are shown in Table 2.

Example 19

Toner particles (19), an external additive toner (19) and a developer (19) are obtained in the same manner as in Example 15 except that the near-infrared absorbing agent particle dispersion solution (5) is used in place of the near-infrared absorbing agent particle dispersion solution (1). Also, the evaluation tests are carried out in the same manner as in Example 1. The results are shown in Table 2.

Example 20

Toner particles (20), an external additive toner (20) and a developer (20) are obtained in the same manner as in Example 15 except that the near-infrared absorbing agent particle dispersion solution (3) is used in place of the near-infrared absorbing agent particle dispersion solution (1) and the additive particle dispersion solution (5) is used in place of the additive particle dispersion solution (4). Also, the evaluation tests are carried out in the same manner as in Example 1. The results are shown in Table 2.

Example 21

Toner particles (21), an external additive toner (21) and a developer (21) are obtained in the same manner as in Example 15 except that the near-infrared absorbing agent particle dispersion solution (3) is used in place of the near-infrared absorbing agent particle dispersion solution (1) and the additive particle dispersion solution (6) is used in place of the additive particle dispersion solution (4). Also, the evaluation tests are carried out in the same manner as in Example 1. The results are shown in Table 2.

Example 22

Toner particles (22), an external additive toner (22) and a developer (22) are obtained in the same manner as in Example 15 except that the near-infrared absorbing agent particle dispersion solution (5) is used in place of the near-infrared absorbing agent particle dispersion solution (1) and the additive particle dispersion solution (7) is used in place of the additive particle dispersion solution (4). Also, the evaluation tests are carried out in the same manner as in Example 1. The results are shown in Table 2.

Example 23

Toner particles (23), an external additive toner (23) and a developer (23) are obtained in the same manner as in Example 8 except that 2-ethylimidazole is used in place of 1-phenylpyrrole. Also, the evaluation tests are carried out in the same manner as in Example 1. The results are shown in Table 2.

Example 24

Toner particles (24), an external additive toner (24) and a developer (24) are obtained in the same manner as in Example 15 except that the near-infrared absorbing agent particle dispersion solution (3) is used in place of the near-infrared absorbing agent particle dispersion solution (1) and the additive amount of the additive particle dispersion solution (4) is changed to 1.5 parts by weight (content of particles: 0.15 parts by weight) from 60 parts by weight. Also, the evaluation tests are carried out in the same manner as in Example 1. The results are shown in Table 2.

Example 25

Toner particles (25), an external additive toner (25) and a developer (25) are obtained in the same manner as in Example 15 except that the near-infrared absorbing agent particle dispersion solution (3) is used in place of the near-infrared absorbing agent particle dispersion solution (1) and the amount of the additive particle dispersion solution (4) is changed to 120 parts by weight (content of particles: 12 parts by weight) from 60 parts by weight. Also, the evaluation tests are carried out in the same manner as in Example 1. The results are shown in Table 2.

Example 26

A developer (26) is obtained in the same manner as in Example 17 except that the amount of the polymethylmethacrylate to be used to coat the carrier is changed to 0.8% (wt % based on the toner). The resin coating ratio of the carrier is 45% based on the surface of the carrier. Also, the evaluation tests are carried out in the same manner as in Example 1. The results are shown in Table 2.

Example 27

A developer (27) is obtained in the same manner as in Example 17 except that the amount of the polymethylmethacrylate to be used to coat the carrier is changed to 1.2% (wt % based on the toner). The resin coating ratio of the carrier is 75% based on the surface of the carrier. Also, the evaluation tests are carried out in the same manner as in Example 1. The results are shown in Table 2.

Example 28

A developer (28) is obtained in the same manner as in Example 17 except that the amount of the polymethylmethacrylate to be used to coat the carrier is changed to 2% (wt % based on the toner). The resin coating ratio of the carrier is 95% based on the surface of the carrier. Also, the evaluation tests are carried out in the same manner as in Example 1. The results are shown in Table 2.

Example 29

A developer (29) is obtained in the same manner as in Example 17 except that the amount of the polymethylmethacrylate to be used to coat the carrier is changed to 3% (wt % based on the toner). The resin coating ratio of the carrier is 98% based on the surface of the carrier. Also, the evaluation tests are carried out in the same manner as in Example 1. The results are shown in Table 2.

TABLE 2

| | Near-infrared absorbing agent particle dispersion solution | Additive particle dispersion solution and amount | Toner D50v [μm] | GSDv | SF1 | Average dispersion diameter [μm] | Toner λ max [nm] | Resin coating ratio of the carrier [%] | Amount of absorption of light at λ max | Restoring rate (%) of invisible information [%] | Visibility by visual observation | Test for light fastness |
|---|---|---|---|---|---|---|---|---|---|---|---|---|
| Example 15 | (1) | (4) 6 parts by weight | 5.70 | 1.23 | 130 | 0.56 | 870 | 85 | 34 | 92 | C | C |

TABLE 2-continued

| | Near-infrared absorbing agent particle dispersion solution | Additive particle dispersion solution and amount | Toner D50v [μm] | GSDv | SF1 | Average dispersion diameter [μm] | Toner λ max [nm] | Resin coating ratio of the carrier [%] | Amount of absorption of light at λ max | Restoring rate (%) of invisible information [%] | Visibility by visual observation | Test for light fastness |
|---|---|---|---|---|---|---|---|---|---|---|---|---|
| Example 16 | (2) | (4) 6 parts by weight | 5.65 | 1.22 | 130 | 0.57 | 860 | 85 | 30 | 90 | C | C |
| Example 17 | (3) | (4) 6 parts by weight | 5.71 | 1.21 | 129 | 0.5 | 850 | 85 | 38 | 94 | B | B |
| Example 18 | (4) | (4) 6 parts by weight | 5.72 | 1.21 | 131 | 0.53 | 855 | 85 | 40 | 95 | A | B |
| Example 19 | (5) | (4) 6 parts by weight | 5.70 | 1.21 | 130 | 0.61 | 840 | 85 | 35 | 92 | C | B |
| Example 20 | (3) | (5) 6 parts by weight | 5.70 | 1.22 | 131 | 0.54 | 850 | 85 | 35 | 92 | C | B |
| Example 21 | (3) | (6) 6 parts by weight | 5.69 | 1.23 | 130 | 0.55 | 850 | 85 | 30 | 90 | C | B |
| Example 22 | (3) | (7) 6 parts by weight | 5.71 | 1.22 | 132 | 0.6 | 850 | 85 | 23 | 82 | C | B |
| Example 23 | Particles of (3) | Particles of (4) | 9.70 | 1.41 | 150 | 0.62 | 850 | 85 | 21 | 82 | C | B |
| Example 24 | (3) | (4) 0.15 parts by weight | 5.70 | 1.21 | 131 | 0.62 | 850 | 85 | 18 | 77 | C | A |
| Example 25 | (3) | (4) 12 parts by weight | 5.71 | 1.21 | 130 | 0.42 | 850 | 85 | 44 | 98 | C | C |
| Example 26 | (3) | (4) 6 parts by weight | 5.71 | 1.21 | 129 | 0.5 | 850 | 45 | 25 | 82 | A | B |
| Example 27 | (3) | (4) 6 parts by weight | 5.71 | 1.21 | 129 | 0.5 | 850 | 75 | 30 | 90 | C | B |
| Example 28 | (3) | (4) 6 parts by weight | 5.71 | 1.21 | 129 | 0.5 | 850 | 95 | 38 | 93 | C | B |
| Example 29 | (3) | (4) 6 parts by weight | 5.71 | 1.21 | 129 | 0.5 | 850 | 98 | 30 | 90 | C | B |
| Comparative Example 1 | (3) | — | 5.71 | 1.19 | 128 | 0.7 | 850 | 85 | 18 | 75 | D | A |

As mentioned above, the electrostatic image developing toners of Examples 15 to 29 can be made to have significantly increased amount of absorption of near-infrared rays compared to conventional near-infrared absorbing agent-containing toners and can be improved in invisible information restoring rate since a nitrogen-containing heterocyclic type additive is contained in the near-infrared absorbing agent-containing toner. Also, the electrostatic image developing toners of Examples 15 to 29 can be improved in the dispersion of the near-infrared absorption agent and invisible information is viewed visually with more difficulty than in the case of using conventional near-infrared absorbing agent-containing toners since a nitrogen-containing heterocyclic type additive is contained in the near-infrared absorbing agent-containing toner.

Example 30

Toner particles (30), an external additive toner (30) and a developer (30) are obtained in the same manner as in Example 1 except that the additive particle dispersion solution (8) is used in place of the additive particle dispersion solution (1). Also, the evaluation tests are carried out in the same manner as in Example 1. The results are shown in Table 3.

Example 31

Toner particles (31), an external additive toner (31) and a developer (31) are obtained in the same manner as in Example 30 except that the near-infrared absorbing agent particle dispersion solution (2) is used in place of the near-infrared absorbing agent particle dispersion solution (1). Also, the evaluation tests are carried out in the same manner as in Example 1. The results are shown in Table 3.

Example 32

Toner particles (32), an external additive toner (32) and a developer (32) are obtained in the same manner as in Example 30 except that the near-infrared absorbing agent particle dispersion solution (3) is used in place of the near-infrared absorbing agent particle dispersion solution (1). Also, the evaluation tests are carried out in the same manner as in Example 1. The results are shown in Table 3.

Example 33

Toner particles (33), an external additive toner (33) and a developer (33) are obtained in the same manner as in Example 30 except that the near-infrared absorbing agent particle dispersion solution (4) is used in place of the near-infrared absorbing agent particle dispersion solution (1). Also, the evaluation tests are carried out in the same manner as in Example 1. The results are shown in Table 3.

Example 34

Toner particles (34), an external additive toner (34) and a developer (34) are obtained in the same manner as in Example 30 except that the near-infrared absorbing agent particle dispersion solution (5) is used in place of the near-infrared absorbing agent particle dispersion solution (1). Also, the evaluation tests are carried out in the same manner as in Example 1. The results are shown in Table 3.

Example 35

Toner particles (35), an external additive toner (35) and a developer (35) are obtained in the same manner as in Example 30 except that the near-infrared absorbing agent particle dispersion solution (3) is used in place of the near-infrared absorbing agent particle dispersion solution (1) and the additive particle dispersion solution (9) is used in place of the additive particle dispersion solution (8). Also, the evaluation tests are carried out in the same manner as in Example 1. The results are shown in Table 3.

Example 36

Toner particles (36), an external additive toner (36) and a developer (36) are obtained in the same manner as in Example 30 except that the near-infrared absorbing agent particle dispersion solution (3) is used in place of the near-infrared absorbing agent particle dispersion solution (1) and the additive particle dispersion solution (10) is used in place of the additive particle dispersion solution (8). Also, the evaluation tests are carried out in the same manner as in Example 1. The results are shown in Table 3.

Example 37

Toner particles (37), an external additive toner (37) and a developer (37) are obtained in the same manner as in Example 30 except that the near-infrared absorbing agent particle dispersion solution (3) is used in place of the near-infrared absorbing agent particle dispersion solution (1) and the additive particle dispersion solution (11) is used in place of the additive particle dispersion solution (8). Also, the evaluation tests are carried out in the same manner as in Example 1. The results are shown in Table 3.

Example 38

Toner particles (38), an external additive toner (38) and a developer (38) are obtained in the same manner as in Example 30 except that the near-infrared absorbing agent particle dispersion solution (3) is used in place of the near-infrared absorbing agent particle dispersion solution (1) and the additive particle dispersion solution (12) is used in place of the additive particle dispersion solution (8). Also, the evaluation tests are carried out in the same manner as in Example 1. The results are shown in Table 3.

Example 39

Toner particles (39), an external additive toner (39) and a developer (39) are obtained in the same manner as in Example 8 except that 2-phenyl-2-imidazoline is used in place of 1-phenylpyrrole. Also, the evaluation tests are carried out in the same manner as in Example 1. The results are shown in Table 3.

Example 40

Toner particles (40), an external additive toner (40) and a developer (40) are obtained in the same manner as in Example 30 except that the near-infrared absorbing agent particle dispersion solution (3) is used in place of the near-infrared absorbing agent particle dispersion solution (1) and the additive amount of the additive particle dispersion solution (8) is changed to 1.5 parts by weight (content of particles: 0.15 parts by weight) from 60 parts by weight. Also, the evaluation tests are carried out in the same manner as in Example 1. The results are shown in Table 3.

Example 41

Toner particles (41), an external additive toner (41) and a developer (41) are obtained in the same manner as in Example 30 except that the near-infrared absorbing agent particle dispersion solution (3) is used in place of the near-infrared absorbing agent particle dispersion solution (1) and the additive amount of the additive particle dispersion solution (8) is changed to 120 parts by weight (content of particles: 12 parts by weight) from 60 parts by weight. Also, the evaluation tests are carried out in the same manner as in Example 1. The results are shown in Table 3.

Example 42

A developer (42) is obtained in the same manner as in Example 32 except that the amount of the polymethylmethacrylate to be used to coat the carrier is changed to 0.8% (wt % based on the toner). The resin coating ratio of the carrier is 45% based on the surface of the carrier. Also, the evaluation tests are carried out in the same manner as in Example 1. The results are shown in Table 3.

Example 43

A developer (43) is obtained in the same manner as in Example 32 except that the amount of the polymethylmethacrylate to be used to coat the carrier is changed to 1.2% (wt % based on the toner). The resin coating ratio of the carrier is 75% based on the surface of the carrier. Also, the evaluation tests are carried out in the same manner as in Example 1. The results are shown in Table 3.

Example 44

A developer (44) is obtained in the same manner as in Example 32 except that the amount of the polymethylmethacrylate to be used to coat the carrier is changed to 2% (wt % based on the toner). The resin coating ratio of the carrier is 95% based on the surface of the carrier. Also, the evaluation tests are carried out in the same manner as in Example 1. The results are shown in Table 3.

Example 45

A developer (45) is obtained in the same manner as in Example 32 except that the amount of the polymethylmethacrylate to be used to coat the carrier is changed to 3% (wt % based on the toner). The resin coating ratio of the carrier is 98% based on the surface of the carrier. Also, the evaluation tests are carried out in the same manner as in Example 1. The results are shown in Table 3.

TABLE 3

| | Near-infrared absorbing agent particle dispersion solution | Additive particle dispersion solution and amount | Toner D50v [μm] | GSDv | SF1 | Average dispersion diameter [μm] | Toner λ max [nm] | Resin coating ratio of the carrier [%] | Amount of absorption of light at λ max | Restoring rate (%) of invisible information [%] | Visibility by visual observation | Test for light fastness |
|---|---|---|---|---|---|---|---|---|---|---|---|---|
| Example 30 | (1) | (8) 6 parts by weight | 5.68 | 1.22 | 130 | 0.53 | 870 | 85 | 33 | 92 | C | C |
| Example 31 | (2) | (8) 6 parts by weight | 5.70 | 1.22 | 130 | 0.55 | 860 | 85 | 30 | 90 | C | C |
| Example 32 | (3) | (8) 6 parts by weight | 5.69 | 1.22 | 131 | 0.49 | 850 | 85 | 38 | 94 | B | B |
| Example 33 | (4) | (8) 6 parts by weight | 5.70 | 1.23 | 130 | 0.51 | 855 | 85 | 40 | 95 | A | B |
| Example 34 | (5) | (8) 6 parts by weight | 5.71 | 1.23 | 129 | 0.53 | 840 | 85 | 37 | 94 | B | B |
| Example 35 | (3) | (9) 6 parts by weight | 5.73 | 1.22 | 133 | 0.58 | 850 | 85 | 30 | 90 | B | B |
| Example 36 | (3) | (10) 6 parts by weight | 5.71 | 1.21 | 131 | 0.60 | 850 | 85 | 26 | 86 | B | B |
| Example 37 | (3) | (11) 6 parts by weight | 5.70 | 1.22 | 130 | 0.63 | 850 | 85 | 22 | 82 | C | A |
| Example 38 | (3) | (12) 6 parts by weight | 5.72 | 1.22 | 131 | 0.64 | 850 | 85 | 24 | 84 | C | B |
| Example 39 | Particles of (3) | Particles of (8) | 9.65 | 1.43 | 151 | 0.65 | 850 | 85 | 20 | 80 | C | B |
| Example 40 | (3) | (8) 0.15 parts by weight | 5.69 | 1.20 | 130 | 0.65 | 850 | 85 | 18 | 77 | C | A |
| Example 41 | (3) | (8) 12 parts by weight | 5.73 | 1.24 | 132 | 0.40 | 850 | 85 | 43 | 96 | C | C |
| Example 42 | (3) | (8) 6 parts by weight | 5.70 | 1.21 | 128 | 0.49 | 850 | 45 | 25 | 83 | A | B |
| Example 43 | (3) | (8) 6 parts by weight | 5.70 | 1.21 | 128 | 0.49 | 850 | 75 | 30 | 90 | C | B |
| Example 44 | (3) | (8) 6 parts by weight | 5.70 | 1.21 | 128 | 0.49 | 850 | 95 | 38 | 94 | C | B |
| Example 45 | (3) | (8) 6 parts by weight | 5.70 | 1.21 | 128 | 0.49 | 850 | 98 | 30 | 90 | C | B |
| Comparative Example 1 | (3) | — | 5.71 | 1.19 | 128 | 0.7 | 850 | 85 | 18 | 75 | D | A |

As mentioned above, since a nitrogen-containing heterocyclic type additive is contained in the near-infrared absorbing agent-containing toner, the electrostatic image developing toners of Examples 30 to 45 can be made to have significantly increased amount of absorption of near-infrared rays compared to conventional near-infrared absorbing agent-containing toners and can be improved in invisible information restoring rate. Also, since a nitrogen-containing heterocyclic type additive is contained in the near-infrared absorbing agent-containing toner, the electrostatic image developing toners of Examples 30 to 45 can be improved in the dispersion of the near-infrared absorption agent, and invisible information is viewed visually with more difficulty than in the case of using conventional near-infrared absorbing agent-containing toners.

Example 46

Toner particles (46), an external additive toner (46) and a developer (46) are obtained in the same manner as in Example 1 except that the additive particle dispersion solution (13) is used in place of the additive particle dispersion solution (1) Also, the evaluation tests are carried out in the same manner as in Example 1. The results are shown in Table 4.

Example 47

Toner particles (47), an external additive toner (47) and a developer (47) are obtained in the same manner as in Example 46 except that the near-infrared absorbing agent particle dispersion solution (2) is used in place of the near-infrared absorbing agent particle dispersion solution (1). Also, the evaluation tests are carried out in the same manner as in Example 1. The results are shown in Table 4.

Example 48

Toner particles (48), an external additive toner (48) and a developer (48) are obtained in the same manner as in Example 46 except that the near-infrared absorbing agent particle dispersion solution (3) is used in place of the near-infrared absorbing agent particle dispersion solution (1). Also, the evaluation tests are carried out in the same manner as in Example 1. The results are shown in Table 4.

Example 49

Toner particles (49), an external additive toner (49) and a developer (49) are obtained in the same manner as in Example 46 except that the near-infrared absorbing agent particle dispersion solution (4) is used in place of the near-infrared absorbing agent particle dispersion solution (1). Also, the evaluation tests are carried out in the same manner as in Example 1. The results are shown in Table 4.

Example 50

Toner particles (50), an external additive toner (50) and a developer (50) are obtained in the same manner as in Example 46 except that the near-infrared absorbing agent particle dispersion solution (5) is used in place of the near-infrared absorbing agent particle dispersion solution (1). Also, the evaluation tests are carried out in the same manner as in Example 1. The results are shown in Table 4.

Example 51

Toner particles (51), an external additive toner (51) and a developer (51) are obtained in the same manner as in Example 46 except that the near-infrared absorbing agent particle dispersion solution (3) is used in place of the near-infrared absorbing agent particle dispersion solution (1) and the additive particle dispersion solution (14) is used in place of the additive particle dispersion solution (13). Also, the evaluation tests are carried out in the same manner as in Example 1. The results are shown in Table 4.

Example 52

Toner particles (52), an external additive toner (52) and a developer (52) are obtained in the same manner as in Example 46 except that the near-infrared absorbing agent particle dispersion solution (3) is used in place of the near-infrared absorbing agent particle dispersion solution (1) and the additive particle dispersion solution (15) is used in place of the additive particle dispersion solution (13). Also, the evaluation tests are carried out in the same manner as in Example 1. The results are shown in Table 4.

Example 53

Toner particles (53), an external additive toner (53) and a developer (53) are obtained in the same manner as in Example 46 except that the near-infrared absorbing agent particle dispersion solution (3) is used in place of the near-infrared absorbing agent particle dispersion solution (1) and the additive particle dispersion solution (16) is used in place of the additive particle dispersion solution (13). Also, the evaluation tests are carried out in the same manner as in Example 1. The results are shown in Table 4.

Example 54

Toner particles (54), an external additive toner (54) and a developer (54) are obtained in the same manner as in Example 8 except that 3-(tert-butoxycarbonylamino)-pyrrolidine is used in place of 1-phenylpyrrole. Also, the evaluation tests are carried out in the same manner as in Example 1. The results are shown in Table 4.

Example 55

Toner particles (55), an external additive toner (55) and a developer (55) are obtained in the same manner as in Example 46 except that the near-infrared absorbing agent particle dispersion solution (3) is used in place of the near-infrared absorbing agent particle dispersion solution (1) and the additive amount of the additive particle dispersion solution (13) is changed to 1.5 parts by weight (content of particles: 0.15 parts by weight) from 60 parts by weight. Also, the evaluation tests are carried out in the same manner as in Example 1. The results are shown in Table 4.

Example 56

Toner particles (56), an external additive toner (56) and a developer (56) are obtained in the same manner as in Example 46 except that the near-infrared absorbing agent particle dispersion solution (3) is used in place of the near-infrared absorbing agent particle dispersion solution (1) and the additive amount of the additive particle dispersion solution (13) is changed to 120 parts by weight (content of particles: 12 parts by weight) from 60 parts by weight. Also, the evaluation tests are carried out in the same manner as in Example 1. The results are shown in Table 4.

Example 57

A developer (57) is obtained in the same manner as in Example 48 except that the amount of the polymethylmethacrylate to be used to coat the carrier is changed to 0.8% (wt % based on the toner). The resin coating ratio of the carrier is 45% based on the surface of the carrier. Also, the evaluation tests are carried out in the same manner as in Example 1. The results are shown in Table 4.

Example 58

A developer (58) is obtained in the same manner as in Example 48 except that the amount of the polymethylmethacrylate to be used to coat the carrier is changed to 1.2% (wt % based on the toner). The resin coating ratio of the carrier is 75% based on the surface of the carrier. Also, the evaluation tests are carried out in the same manner as in Example 1. The results are shown in Table 4.

Example 59

A developer (59) is obtained in the same manner as in Example 48 except that the amount of the polymethylmethacrylate to be used to coat the carrier is changed to 2% (wt % based on the toner). The resin coating ratio of the carrier is 95% based on the surface of the carrier. Also, the evaluation tests are carried out in the same manner as in Example 1. The results are shown in Table 4.

Example 60

A developer (60) is obtained in the same manner as in Example 48 except that the amount of the polymethylmethacrylate to be used to coat the carrier is changed to 3% (wt % based on the toner). The resin coating ratio of the carrier is 98% based on the surface of the carrier. Also, the evaluation tests are carried out in the same manner as in Example 1. The results are shown in Table 4.

TABLE 4

| | Near-infrared absorbing agent particle dispersion solution | Additive particle dispersion solution and amount | Toner D50v [μm] | GSDv | SF1 | Average dispersion diameter [μm] | Toner λ max [nm] | Resin coating ratio of the carrier [%] | Amount of absorption of light at λ max | Restoring rate (%) of invisible information [%] | Visibility by visual observation | Test for light fastness |
|---|---|---|---|---|---|---|---|---|---|---|---|---|
| Example 46 | (1) | (13) 6 parts by weight | 5.70 | 1.21 | 131 | 0.58 | 870 | 85 | 37 | 94 | C | B |
| Example 47 | (2) | (13) 6 parts by weight | 5.71 | 1.21 | 131 | 0.59 | 860 | 85 | 33 | 92 | C | B |
| Example 48 | (3) | (13) 6 parts by weight | 5.72 | 1.22 | 131 | 0.55 | 850 | 85 | 40 | 95 | B | B |
| Example 49 | (4) | (13) 6 parts by weight | 5.72 | 1.22 | 130 | 0.5 | 855 | 85 | 43 | 96 | A | B |
| Example 50 | (5) | (13) 6 parts by weight | 5.73 | 1.21 | 131 | 0.51 | 840 | 85 | 39 | 95 | B | B |
| Example 51 | (3) | (14) 6 parts by weight | 5.72 | 1.23 | 131 | 0.57 | 850 | 85 | 37 | 94 | B | A |
| Example 52 | (3) | (15) 6 parts by weight | 5.69 | 1.22 | 132 | 0.59 | 850 | 85 | 33 | 92 | B | B |
| Example 53 | (3) | (16) 6 parts by weight | 5.70 | 1.21 | 132 | 0.6 | 850 | 85 | 31 | 90 | C | B |
| Example 54 | Particles of (3) | Particles of (13) | 9.80 | 1.45 | 154 | 0.62 | 850 | 85 | 28 | 88 | C | B |
| Example 55 | (3) | (13) 0.15 parts by weight | 5.72 | 1.20 | 129 | 0.62 | 850 | 85 | 23 | 83 | C | A |
| Example 56 | (3) | (13) 12 parts by weight | 5.73 | 1.24 | 133 | 0.44 | 850 | 85 | 48 | 97 | C | B |
| Example 57 | (3) | (13) 6 parts by weight | 5.72 | 1.22 | 132 | 0.55 | 850 | 45 | 26 | 83 | A | A |
| Example 58 | (3) | (13) 6 parts by weight | 5.72 | 1.22 | 132 | 0.55 | 850 | 75 | 32 | 91 | C | A |
| Example 59 | (3) | (13) 6 parts by weight | 5.72 | 1.22 | 132 | 0.55 | 850 | 95 | 40 | 95 | C | A |
| Example 60 | (3) | (13) 6 parts by weight | 5.72 | 1.22 | 132 | 0.55 | 850 | 98 | 33 | 92 | C | A |
| Comparative Example 1 | (3) | — | 5.71 | 1.19 | 128 | 0.7 | 850 | 85 | 18 | 75 | D | A |

As mentioned above, since a nitrogen-containing heterocyclic type additive is contained in the near-infrared absorbing agent-containing toner, the electrostatic image developing toners of Examples 46 to 60 can be made to have significantly increased amount of absorption of near-infrared rays compared to conventional near-infrared absorbing agent-containing toners, and can be improved in invisible information restoring rate. Also, since a nitrogen-containing heterocyclic type additive is contained in the near-infrared absorbing agent-containing toner, the electrostatic image developing toners of Examples 46 to 60 can be improved in the dispersion of the near-infrared absorption agent, and invisible information is viewed visually with more difficulty than in the case of using conventional near-infrared absorbing agent-containing toners.

Example 61

Toner particles (61), an external additive toner (61) and a developer (61) are obtained in the same manner as in Example 1 except that the additive particle dispersion solution (17) is used in place of the additive particle dispersion solution (1). Also, the evaluation tests are carried out in the same manner as in Example 1. The results are shown in Table 5.

Example 62

Toner particles (62), an external additive toner (62) and a developer (62) are obtained in the same manner as in Example 61 except that the near-infrared absorbing agent particle dispersion solution (2) is used in place of the near-infrared absorbing agent particle dispersion solution (1). Also, the evaluation tests are carried out in the same manner as in Example 1. The results are shown in Table 5.

Example 63

Toner particles (63), an external additive toner (63) and a developer (63) are obtained in the same manner as in Example 61 except that the near-infrared absorbing agent particle dispersion solution (3) is used in place of the near-infrared absorbing agent particle dispersion solution (1). Also, the evaluation tests are carried out in the same manner as in Example 1. The results are shown in Table 5.

Example 64

Toner particles (64), an external additive toner (64) and a developer (64) are obtained in the same manner as in Example 61 except that the near-infrared absorbing agent particle dispersion solution (4) is used in place of the near-infrared absorbing agent particle dispersion solution (1). Also, the evaluation tests are carried out in the same manner as in Example 1. The results are shown in Table 5.

Example 65

Toner particles (65), an external additive toner (65) and a developer (65) are obtained in the same manner as in Example 61 except that the near-infrared absorbing agent particle dispersion solution (5) is used in place of the near-infrared absorbing agent particle dispersion solution (1). Also, the evaluation tests are carried out in the same manner as in Example 1. The results are shown in Table 5.

Example 66

Toner particles (66), an external additive toner (66) and a developer (66) are obtained in the same manner as in Example 61 except that the near-infrared absorbing agent particle dispersion solution (3) is used in place of the near-infrared absorbing agent particle dispersion solution (1) and the additive particle dispersion solution (18) is used in place of the additive particle dispersion solution (17). Also, the evaluation tests are carried out in the same manner as in Example 1. The results are shown in Table 5.

Example 67

Toner particles (67), an external additive toner (67) and a developer (67) are obtained in the same manner as in Example 61 except that the near-infrared absorbing agent particle dispersion solution (3) is used in place of the near-infrared absorbing agent particle dispersion solution (1) and the additive particle dispersion solution (19) is used in place of the additive particle dispersion solution (17). Also, the evaluation tests are carried out in the same manner as in Example 1. The results are shown in Table 5.

Example 68

Toner particles (68), an external additive toner (68) and a developer (68) are obtained in the same manner as in Example 8 except that 5-(ethylthio)-1H-tetrazole is used in place of 1-phenylpyrrole. Also, the evaluation tests are carried out in the same manner as in Example 1. The results are shown in Table 5.

Example 69

Toner particles (69), an external additive toner (69) and a developer (69) are obtained in the same manner as in Example 61 except that the near-infrared absorbing agent particle dispersion solution (3) is used in place of the near-infrared absorbing agent particle dispersion solution (1) and the additive amount of the additive particle dispersion solution (17) is changed to 1.5 parts by weight (content of particles: 0.15 parts by weight) from 60 parts by weight. Also, the evaluation tests are carried out in the same manner as in Example 1. The results are shown in Table 5.

Example 70

Toner particles (70), an external additive toner (70) and a developer (70) are obtained in the same manner as in Example 61 except that the near-infrared absorbing agent particle dispersion solution (3) is used in place of the near-infrared absorbing agent particle dispersion solution (1) and the additive amount of the additive particle dispersion solution (17) is changed to 120 parts by weight (content of particles: 12 parts by weight) from 60 parts by weight. Also, the evaluation tests are carried out in the same manner as in Example 1. The results are shown in Table 5.

Example 71

A developer (71) is obtained in the same manner as in Example 63 except that the amount of the polymethylmethacrylate to be used to coat the carrier is changed to 0.8% (wt % based on the toner). The resin coating ratio of the carrier is 45% based on the surface of the carrier. Also, the evaluation tests are carried out in the same manner as in Example 1. The results are shown in Table 5.

Example 72

A developer (72) is obtained in the same manner as in Example 63 except that the amount of the polymethylmethacrylate to be used to coat the carrier is changed to 1.2% (wt % based on the toner). The resin coating ratio of the carrier is 75% based on the surface of the carrier. Also, the evaluation tests are carried out in the same manner as in Example 1. The results are shown in Table 5.

Example 73

A developer (73) is obtained in the same manner as in Example 63 except that the amount of the polymethylmethacrylate to be used to coat the carrier is changed to 2% (wt % based on the toner). The resin coating ratio of the carrier is 95% based on the surface of the carrier. Also, the evaluation tests are carried out in the same manner as in Example 1. The results are shown in Table 5.

Example 74

A developer (74) is obtained in the same manner as in Example 63 except that the amount of the polymethylmethacrylate to be used to coat the carrier is changed to 3% (wt % based on the toner). The resin coating ratio of the carrier is 98% based on the surface of the carrier. Also, the evaluation tests are carried out in the same manner as in Example 1. The results are shown in Table 5.

TABLE 5

| | Near-infrared absorbing agent particle dispersion solution | Additive particle dispersion solution and amount | Toner D50v [μm] | GSDv | SF1 | Average dispersion diameter [μm] | Toner λ max [nm] | Resin coating ratio of the carrier [%] | Amount of absorption of light at λ max | Restoring rate (%) of invisible information [%] | Visibility by visual observation | Test for light fastness |
|---|---|---|---|---|---|---|---|---|---|---|---|---|
| Example 61 | (1) | (17) 6 parts by weight | 5.7 | 1.22 | 131 | 0.45 | 870 | 85 | 38 | 94 | B | D |
| Example 62 | (2) | (17) 6 parts by weight | 5.69 | 1.21 | 132 | 0.46 | 860 | 85 | 35 | 92 | B | D |
| Example 63 | (3) | (17) 6 parts by weight | 5.72 | 1.22 | 131 | 0.4 | 850 | 85 | 43 | 96 | B | C |
| Example 64 | (4) | (17) 6 parts by weight | 5.68 | 1.21 | 130 | 0.42 | 855 | 85 | 47 | 98 | A | C |

TABLE 5-continued

| | Near-infrared absorbing agent particle dispersion solution | Additive particle dispersion solution and amount | Toner D50v [μm] | GSDv | SF1 | Average dispersion diameter [μm] | Toner λ max [nm] | Resin coating ratio of the carrier [%] | Amount of absorption of light at λ max | Restoring rate (%) of invisible information [%] | Visibility by visual observation | Test for light fastness |
|---|---|---|---|---|---|---|---|---|---|---|---|---|
| Example 65 | (5) | (17) 6 parts by weight | 5.72 | 1.22 | 133 | 0.45 | 840 | 85 | 39 | 94 | B | D |
| Example 66 | (3) | (18) 6 parts by weight | 5.7 | 1.23 | 134 | 0.44 | 850 | 85 | 40 | 95 | B | D |
| Example 67 | (3) | (19) 6 parts by weight | 5.66 | 1.23 | 133 | 0.46 | 850 | 85 | 36 | 92 | B | D |
| Example 68 | Particles of (3) | Particles of (17) | 9.71 | 1.42 | 151 | 0.6 | 850 | 85 | 26 | 82 | B | D |
| Example 69 | (3) | (17) 0.15 parts by weight | 5.74 | 1.2 | 129 | 0.44 | 850 | 85 | 19 | 78 | C | D |
| Example 70 | (3) | (17) 12 parts by weight | 5.72 | 1.22 | 131 | 0.33 | 850 | 85 | 51 | 99 | A | C |
| Example 71 | (3) | (17) 6 parts by weight | 5.72 | 1.22 | 131 | 0.4 | 850 | 45 | 29 | 89 | C | D |
| Example 72 | (3) | (17) 6 parts by weight | 5.72 | 1.22 | 131 | 0.4 | 850 | 75 | 33 | 91 | B | D |
| Example 73 | (3) | (17) 6 parts by weight | 5.72 | 1.22 | 131 | 0.4 | 850 | 95 | 43 | 96 | A | C |
| Example 74 | (3) | (17) 6 parts by weight | 5.72 | 1.22 | 131 | 0.4 | 850 | 98 | 40 | 95 | B | D |
| Comparative Example 1 | (3) | — | 5.71 | 1.19 | 128 | 0.7 | 850 | 85 | 18 | 75 | D | A |

As mentioned above, since a nitrogen-containing heterocyclic type additive is contained in the near-infrared absorbing agent-containing toner, the electrostatic image developing toners of Examples 61 to 74 can be made to have significantly increased amount of absorption of near-infrared rays compared to conventional near-infrared absorbing agent-containing toners, and can be improved in invisible information restoring rate. Also, since a nitrogen-containing heterocyclic type additive is contained in the near-infrared absorbing agent-containing toner, the electrostatic image developing toners of Examples 61 to 74 can be improved in the dispersion of the near-infrared absorption agent, and invisible information is viewed visually with more difficulty than in the case of using conventional near-infrared absorbing agent-containing toners.

As is understood from Tables 1 to 5, the affinity of the additive to the near-infrared absorbing agent is improved and the secondary coagulation of the near-infrared absorbing agent particles can be suppressed with an increase in the number of nitrogen atoms in the ring. On the other hand, the toner is reduced in discoloration as the number of nitrogen atoms in the ring is smaller. Also, the discoloration of the toner is decreased with a decrease in the number of double bonds in the ring.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic image developing toner comprising:

at least one of a phthalocyanine type compound and a naphthalocyanine type compound; and a compound represented by the following structural formula (1):

(1)

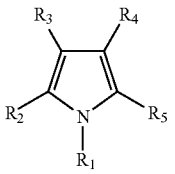

where $R_1$ to $R_5$ respectively represent a hydrogen atom, an unsubstituted alkyl group, an aryl group, an arylalkyl group, a halogen group, an alkoxy group, an alkylthio group, a nitro group, a hydroxy group, a thiol group, a carboxyamide group, or a nitroimino group, wherein among $R_1$ to $R_5$, any two adjacent Rs may form an unsubstituted carbon ring and when two Rs are connected to the same carbon atom, they may form an oxo group, an imino group, or a thioxo group.

2. An electrostatic image developing toner according to claim 1, wherein the compound represented by the structural formula (1) has a melting temperature of about 10° C. or more and about 200° C. or less.

3. An electrostatic image developing toner according to claim 1, wherein the phthalocyanine type compound or the naphthalocyanine type compound has an average dispersion diameter of about 1 μm or less.

4. An electrostatic image developing toner according to claim 1, wherein the phthalocyanine type compound or the naphthalocyanine type compound has absorption in the visible wavelength region and in the near-infrared wavelength region and has a maximum absorption wavelength in the near-infrared wavelength region.

5. An electrostatic image developing toner according to claim 1, the toner having a volume average particle diameter D50v of about 3 μm or more and about 6 μm or less.

6. An electrostatic image developing toner according to claim 1, the toner having a volume average grain size distribution index GSDv of about 1.0 or more and about 1.3 or less.

7. An electrostatic image developing toner according to claim 1, the toner having a shape factor SF1 of about 110 or more and about 140 or less.

8. The electrostatic image developing toner according to claim 1, wherein the compound represented by structural formula (1) has at least one unsubstituted alkyl group, the unsubstituted alkyl group being a methyl or an ethyl.

9. An invisible information toner comprising:

at least one of a phthalocyanine type compound and a naphthalocyanine type compound; and a compound represented by the following structural formula (1):

(1)

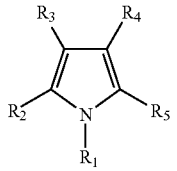

where $R_1$ to $R_5$ respectively represent a hydrogen atom, an unsubstituted alkyl group, an aryl group, an arylalkyl group, a halogen group, an alkoxy group, an alkylthio group, a nitro group, a hydroxy group, a thiol group, a carboxyamide group, or a nitroimino group, wherein among $R_1$ to $R_5$, any two adjacent Rs may form an unsubstituted carbon ring and when two Rs are connected to the same carbon atom, they may form an oxo group, an imino group, or a thioxo group.

10. An invisible information toner according to claim 9, wherein the compound represented by the structural formula (1) has a melting temperature of about 10° C. or more and about 200° C. or less.

11. An invisible information toner according to claim 9, wherein the phthalocyanine type compound or the naphthalocyanine type compound has an average dispersion diameter of about 1 μm or less.

12. An invisible information toner according to claim 9, wherein the phthalocyanine type compound or the naphthalocyanine type compound has absorption in the near-infrared wavelength region and has a maximum absorption wavelength in the near-infrared wavelength region.

13. An invisible information toner according to claim 9, wherein the total content of the phthalocyanine type compound or the naphthalocyanine type compound is about 0.1% by weight or more and about 10% by weight or less based on the total weight of the solid constituting the toner.

14. An invisible information toner according to claim 9, wherein the maximum absorption wavelength λmax of the phthalocyanine type compound or the naphthalocyanine type compound is about 800 nm or more and about 1200 nm or less.

15. An invisible information toner according to claim 9, the toner having a volume average particle diameter D50v of about 3 μm or more and about 6 μm or less.

16. An invisible information toner according to claim 9, the toner having a volume average grain size distribution index GSDv of about 1.0 or more and about 1.3 or less.

17. An invisible information toner according to claim 9, the toner having a shape factor SF1 of about 110 or more and about 140 or less.

18. An electrostatic image developer comprising:

an electrostatic image developing toner comprising:

at least one of a phthalocyanine type compound and a naphthalocyanine type compound and a compound represented by the following structural formula 1; and a carrier having a resin coating ratio of about 50% or more and about 98% or less based on a surface of the carrier, (1)

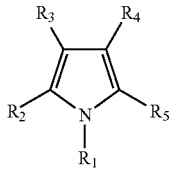

where $R_1$ to $R_5$ respectively represent a hydrogen atom, an unsubstituted alkyl group, an aryl group, an arylalkyl group, a halogen group, an alkoxy group, an alkylthio group, a nitro group, a hydroxy group, a thiol group, a carboxyamide group, or a nitroimino group, wherein among $R_1$ to $R_5$, any two adjacent Rs may form an unsubstituted carbon ring and when two Rs are connected to the same carbon atom, they may form an oxo group, an imino group, or a thioxo group.

* * * * *